US010286515B2

(12) United States Patent
DeCore et al.

(10) Patent No.: US 10,286,515 B2
(45) Date of Patent: May 14, 2019

(54) SLUG RETENTION GROOVE FORMING MACHINE AND METHOD OF USE AND OPERATION THEREOF

(71) Applicant: DTC Products, Inc., St. Charles, IL (US)

(72) Inventors: Jeffrey A. DeCore, St. Charles, IL (US); Robert B. DeCore, Batavia, IL (US)

(73) Assignee: DTC Products, Inc., St. Charles, IL (US)

( * ) Notice: Subject to any disclaimer, the term of this patent is extended or adjusted under 35 U.S.C. 154(b) by 0 days.

(21) Appl. No.: 15/652,495

(22) Filed: Jul. 18, 2017

(65) Prior Publication Data

US 2017/0312876 A1 Nov. 2, 2017

Related U.S. Application Data

(63) Continuation-in-part of application No. 14/873,446, filed on Oct. 2, 2015, now Pat. No. 9,908,210, which is a continuation of application No. 13/828,399, filed on Mar. 14, 2013, now Pat. No. 9,149,902.

(60) Provisional application No. 61/612,226, filed on Mar. 16, 2012, provisional application No. 62/365,368, filed on Jul. 21, 2016.

(51) Int. Cl.
*B24B 23/02* (2006.01)
*B24B 19/20* (2006.01)

(52) U.S. Cl.
CPC ..... *B24B 19/20* (2013.01); *B24B 23/026* (2013.01)

(58) Field of Classification Search
CPC ..... B24B 19/20; B24B 23/026; B24B 23/00; B24B 23/08
USPC ..... 451/344, 340, 363, 358, 294, 295, 231, 451/233, 439
See application file for complete search history.

(56) References Cited

U.S. PATENT DOCUMENTS

| | | | |
|---|---|---|---|
| 1,326,462 | A | 12/1919 | Murch |
| 1,654,213 | A | 12/1927 | Einstein et al. |
| 2,328,098 | A | 8/1943 | Remington et al. |
| 2,359,594 | A | 10/1944 | Turenchalk et al. |

(Continued)

FOREIGN PATENT DOCUMENTS

| | | | |
|---|---|---|---|
| CN | 202037258 | U | 11/2011 |
| CN | 102699792 | B | 4/2015 |

(Continued)

*Primary Examiner* — Robert Rose
(74) *Attorney, Agent, or Firm* — Boyle Fredrickson S.C.

(57) ABSTRACT

A portable and transportable die cavity modifying machine having a base carrying a carriage adjustable along one axis, e.g., a generally horizontal axis, and a machining head adjustable along another axis, e.g., a generally vertical axis, for modifying a die cavity of a stamping die in a manner that prevents blank or slug pulling during stamping press operation. The machine includes a stop that is adjustably connected to the carriage. The stop is configured to limit movement of the machining head along the generally vertical axis. The machine may also feature a vibration isolator that is used with the stop to prevent noise and vibration that result from movement of the machining head in relation to the stop. Additionally, the machine may include an optical device capable of capturing an image of the die cavity defining sidewall as the rotary grinding bit machines the elongate slug retention groove.

32 Claims, 14 Drawing Sheets

(56) References Cited

U.S. PATENT DOCUMENTS

| | | | | | |
|---|---|---|---|---|---|
| 2,404,793 | A | | 7/1946 | Dickerman | |
| 2,428,248 | A | | 9/1947 | Strong | |
| 2,545,453 | A | | 3/1951 | Forss | |
| 2,604,167 | A | | 7/1952 | Oliver | |
| 2,849,840 | A | | 9/1958 | Stoeckel | |
| 2,888,786 | A | | 6/1959 | Place | |
| RE25,463 | E | | 10/1963 | Skoog | |
| 3,358,538 | A | | 12/1967 | Maceyka | |
| 3,858,362 | A | | 1/1975 | Welsch | |
| 3,959,929 | A | * | 6/1976 | Fleischmann | B24B 35/00 219/69.11 |
| 4,022,106 | A | * | 5/1977 | Kile | B23C 1/20 409/178 |
| 4,250,731 | A | | 2/1981 | Cremer | |
| 4,543,865 | A | | 10/1985 | Kramski | |
| 4,959,902 | A | | 10/1990 | Hamilton | |
| 4,974,479 | A | | 12/1990 | Bakermans et al. | |
| 5,032,051 | A | * | 7/1991 | Gilmore | B23C 1/20 33/293 |
| 5,046,232 | A | | 9/1991 | Mise | |
| 5,136,907 | A | | 8/1992 | Bakermans et al. | |
| 5,161,291 | A | * | 11/1992 | Guenther | B23C 3/00 29/56.5 |
| 5,305,557 | A | | 4/1994 | Warncke | |
| 6,158,528 | A | | 12/2000 | Izumisawa | |
| 6,357,094 | B1 | * | 3/2002 | Sugimoto | B23Q 1/012 29/26 A |
| 6,997,363 | B1 | | 2/2006 | Vossen | |
| 7,210,384 | B2 | | 5/2007 | Elynuik | |
| 8,701,532 | B2 | | 4/2014 | Laib | |
| 8,764,516 | B2 | | 7/2014 | Nelson | |
| 9,364,884 | B1 | | 6/2016 | Cooper, Jr. | |
| 2016/0039065 | A1 | | 2/2016 | DeCore et al. | |

FOREIGN PATENT DOCUMENTS

| | | | |
|---|---|---|---|
| GB | 2169233 | | 9/1988 |
| JP | 2004202667 | A | 7/2004 |
| JP | 2006239813 | A | 9/2006 |
| KR | 10-2011-0002177 | A | 1/2011 |
| KR | 10-2011-0101714 | A | 9/2011 |

* cited by examiner

SLUG RETENTION GROOVE FORMING MACHINE AND METHOD OF USE AND OPERATION THEREOF

CROSS-REFERENCE

This application claims priority in U.S. Appln. Ser. No. 62/365,368, filed Jul. 21, 2016 and is a continuation-in-part of presently co-pending U.S. application Ser. No. 14/873,446, filed Oct. 2, 2015, which in turn is a continuation of U.S. application Ser. No. 13/828,399, filed Mar. 14, 2013, which issued as U.S. Pat. No. 9,149,902, on Oct. 6, 2015, which itself claims priority in U.S. Appln. No. 61/612,226, filed Mar. 16, 2012, the entirety of each of which is expressly incorporated by reference herein.

FIELD

The present invention relates generally to a machine and method for modifying a cavity of a die with a groove to retain slugs or blanks within the die cavity so the slug or blank does not pull out of the die during stamping operation, and more particularly to a machine with adjustable and vibration noise dampened machining head travel stops that improves accuracy of the groove depth by allowing the operator to hear the groove machining bit touch the die cavity sidewall while preventing the operator from hearing the machining head when it touches the machining head travel stops.

BACKGROUND

During metal stamping, a sheet of metal is positioned over a die opening or die cavity before a punch is rapidly pushed through the sheet into the die opening or cavity of cutting a blank or slug from the sheet having substantially the same shape or contour as the profile of the die cavity. Particularly where the blank or slug is intended to be pushed through the die cavity, retraction of the punch can cause the blank or slug to undesirably pull out of the die.

To prevent circular blanks or slugs from pulling out of the die, Kramski, U.S. Pat. No. 4,543,865, discloses machining a small groove into part of the sidewall defining the die cavity that provides interference by causing part of the blank or slug formed during stamping to expand into the groove. As a result of the blank or slug expanding into the groove during stamping, pressure between the blank or slug and die land occurs preventing the blank or slug from pulling back through the top of the die and onto the work zone.

DeCore, U.S. Pat. No. 9,149,902, the entirety of which is expressly incorporated herein by reference, discloses a portable and transportable die cavity modifying machine that allowed a die cavity to be stamped in a manner that prevents blank or slug pulling during stamping press operation. While the machine disclosed in DeCore offers a number of significant advantages over the prior art, improvements to it are nonetheless desirable.

What is needed is a machine and method for machining one or more slug keeping grooves or slug retention grooves in a die more quickly and efficiently. What is also needed is a machine and method that minimizes unwanted noise produced by vibration of parts when the machine is in operation.

SUMMARY

The present invention is directed to a machine for modifying a cavity of a stamping die by forming an elongate slug retention groove in a sidewall of a die cavity that helps prevent pulling of a blank or slug during stamping press operation using the slug retention groove modified die. A preferred slug retention groove forming machine is mountable on an outer surface of the die adjacent the die cavity and has a machining head that carries a machine tool equipped with a groove machining insert that preferably is a rotary cutting or grinding bit used to machine the slug retention groove in the die cavity sidewall. The machining head in turn is carried by a movable slide block of a slide arrangement that enables machining head and groove grinding bit movement during machine operation. The slide arrangement is configured to enable the machining head and bit to move along a maximum range of travel from a starting height downwardly toward the die cavity sidewall and into contact therewith during machining of a slug retention groove in the cavity sidewall, and thereafter upwardly away from the cavity and cavity sidewall during return of the machining head to the prior starting height.

A vibration dampening arrangement is provided that absorbs and dampens, reduces, or otherwise isolates vibration caused by rotating bit contact with the cavity sidewall reducing chatter and walking of the bit during groove machining by preventing direct contact between the machining head and a machining head travel-limiting stop of the machine. The vibration dampening arrangement also advantageously prevents, suppresses, reduces, and/or minimizes audible sound previously produced due to contact between the machining head and the stop that masked or interfered with sound produced by contact between the rotating bit and cavity sidewall during groove machining enabling the actual sound of groove machining to be used as audible feedback by an operator of the machine to facilitate machining of the groove.

A preferred embodiment of a slug retention groove forming machine of the present invention is configured to be used with a removable and position-adjustable machining head stop of the invention that is mounted to the machine and which enables changing or adjustment of at least at least one of the machining head starting height, a bottom-most machining head travel stop position, and/or a machining head maximum travel range. As discussed in more detail below, a plurality, preferably a plurality of pairs, i.e., at least three, removable, position-adjustable stops of differing configurations can be and preferably are provided for use with the machine. Where such a removable and position-adjustable stop is used, it preferably is mounted to the machine in operable cooperation with one of the machining head and slide arrangement and configured to enable changing or adjustment of The machine can also be and preferably also is equipped with an imaging system that uses a camera to image the cavity sidewall and inspect the groove, including in real time during groove machining advantageously enabling a bit touching the cavity sidewall to be viewed by the machine operator advantageously enabling groove depth to be more accurately and consistently achieved. Where equipped with such an imaging system, the imaging system preferably also is used by the operator during pre-machining setup to position the machining head and bit relative to the die cavity and upper edge of the cavity sidewall, in setting the starting height of the machining head thereby setting the height of the bit relative to the die cavity and upper edge of the cavity sidewalls, in setting the bottom-most machining head and bit travel stop position, and/or in setting the range of travel of the machining head and bit during groove machining.

A maximum range of machining head, tool and bit travel of the machine is defined by a generally vertically extending slide arrangement having a movable slide block in operable cooperation with a grounded portion of the machine that preferably is another slide block fixed to machine ground. In a preferred embodiment, the slide arrangement is operatively connected to a slide block that is a fixed slide block that is grounded to the machine during groove machining with the machining head, tool and bit carried by the movable slide block for movement substantially in unison with the movable slide block during groove machining. In a preferred embodiment, the slide arrangement is configured with a pre-slug retention groove machining starting position relative to the die cavity and cavity sidewall that defines a maximum pre-slug retention groove machining starting height above an outer surface of the die adjacent the die cavity and cavity sidewall from which the machining head, tool and bit is displaced downwardly toward the die cavity and cavity sidewall and into the die cavity to machine the slug retention groove in the cavity sidewall. The slide arrangement can also be configured to limit downward machining head, tool and bit travel toward the die cavity and cavity sidewall with a preferred slide arrangement configured to provide a maximum downward machining head travel stop position beyond which the machining head, tool and bit cannot travel. A slug retention groove forming machine of the present invention is equipped with such a slide arrangement that defines a maximum range of machining head travel by accordingly defining a maximum distance or extent between the maximum pre-slug retention groove machining starting position or starting height and the maximum downward machining head travel stop position or finishing depth that the machining head, tool and bit can travel, including reciprocate, in machining a slug retention groove in the die cavity sidewall.

The machine can and preferably does have a machining head return in the form of a machining head biasing element that is disposed in operable cooperation with the slide arrangement. In a preferred embodiment, the biasing element is or includes a biasing spring, which can be a fluid-powered spring, e.g. viscous-damped fluid-powered spring, such as a gas spring, but which also can be a coil spring, which is disposed in operable cooperation with at least one and preferably both the movable and fixed slide blocks that biases the movable slide block and machining head, tool and bit upwardly away from the die cavity and cavity sidewall to automatically return the machining head, tool and bit to the pre-slug retention groove machining starting position or height. Such a machining head return preferably is an automatic machining head return that automatically returns the machining head, tool and bit to the pre-slug retention groove machining starting position or height when the machining head is released during use and operation of the machine.

The maximum machining head travel range can be reduced by installation of a position-adjustable stop that operatively cooperates with the slide arrangement when mounted to the machine to provide (a) a pre-slug retention groove machining head, tool and bit starting position or height disposed from the maximum pre-slug retention groove machining starting position or height closer to the sidewall of the die cavity in which a slug retention groove is to be machined, (b) a downward machining head travel stop position less than or disposed above the maximum downward machining head, tool and bit travel stop position, and/or (c) a reduced or more limited range of machining head, tool and bit travel that is less than the maximum range of machining head, tool and bit travel that the machine possesses without any such stop installed. Such a stop has a mounting base from which an outwardly extending machining head motion-limiting abutment arm is disposed in operable cooperation with the slide arrangement that accordingly limits machining head, tool and bit starting position or height, movement, and/or range of travel. During use and operation of the machine, the abutment arm of the stop interferes with movement of the movable slide block, machining head, tool and bit when a designated starting or stopping position or range of travel has been reached. In a preferred embodiment, the abutment arm of the stop interferes with movement of the movable slide block of the slide arrangement which thereby in turn interferes with movement of the machining head, tool and bit when the designated starting or stopping position or range of travel defined by the stop has been reached.

The stop includes a position-adjustable mounting assembly that enables mounting of the stop to the machine in one of at least a plurality, preferably a plurality of pairs, i.e., at least three, of positions along an elongate mounting region on the machine. The stop mounting assembly is composed of a plurality of spaced apart mounts each formed of a mounting slot formed in a plate of the mounting base that receives a fastener, preferably thumbscrew, used to releasably and position-adjustably mount the stop to the machine. In attaching the stop to the machine, the fasteners are releasably tightened to position-adjustably mount the stop to the machine in a manner that enables an abutment arm position or height of the stop to be adjustably positioned or moved, e.g., slidably positioned or moved, along the machine relative to the die cavity and cavity sidewall before being further tightened to position-fix mount the stop to the machine in a manner that preferably substantially immovably grounds the stop to the machine.

In a preferred embodiment, the maximum bottom-most machining head travel stop position of machining head travel without any stop installed is defined by a machining head travel limiter that limits downward travel of the machining head toward the die cavity and cavity sidewall. The travel limiter includes a machining head travel limiting stop arm that operatively cooperates with movable and fixed slide blocks of the slide arrangement without any stop installed to at least limit the distance of downward travel of the machining head, tool and bit carried by the movable slide block toward and into the die cavity. In a preferred embodiment, the stop arm is integrally formed of a top portion of the movable slide block, preferably formed of at least part of a movable slide block end cap, which overhangs a top portion of the fixed slide block with the top portion of the fixed slide block preferably providing a stop landing against which the stop arm abuts to stop the machining head, tool and bit at the maximum bottom-most travel stop position. Where the slide arrangement includes an automatic machining head return, the machining head return biasing element, preferably coiled spring, urges the machining head, tool and bit upwardly away from the die cavity and cavity sidewall automatically returning the machining head, tool and bit to the maximum pre-slug retention groove machining starting position without any stop installed.

In a preferred embodiment, a plurality, preferably a plurality of pairs, i.e. at least three, of stops are provided in a system of stops of the present invention with a first one of the stops being a downward machining head travel limiting stop with the machining head motion limiting abutment arm of the stop limiting the range of machining head travel to less than the maximum range without any stop installed by the abutment arm providing a bottom-most machining head travel stop position spaced from and preferably at a height relative to the die cavity and cavity sidewall higher than the maximum bottom-most travel stop position without any stop installed. When the downward machining head travel limiting stop is installed, downward travel of the machining is stopped by the machining head stop arm abutting against the machining head motion limiting abutment arm of the stop. Reducing the range of machining head travel from the maximum range by using the downward machining head travel limiting stop advantageously reduces the distance the machining head, tool and bit must travel during groove machining thereby machining the groove in less time advantageously increasing the production rate of the machine.

A second one of the stops preferably is a machining head travel range limiting stop having a pair of spaced apart the machining head motion limiting abutment arms with (a) an upper one of the abutment arms defining a pre-slug retention groove machining starting position or height closer to the die cavity and cavity sidewall than the maximum pre-slug retention groove machining starting position or height with no stop installed, and (b) a lower one of the abutment arms defining a bottom-most machining head travel stop position that is less than and higher than the maximum bottom-most machining head travel stop position with no stop installed. In a preferred stop embodiment, the upper and lower abutment arms are formed of an elongate flange extending outwardly from the stop mounting base, e.g., extending outwardly from the mounting plate, in which a machining head travel range limiting stop arm travel range-defining recess is formed dividing the flange into two spaced apart segments that respectively provide the upper and lower abutment arms.

During position-adjustable mounting of the stop to the machine, the location of the upper abutment arm along with the pre-slug retention groove machining starting position or height is set by the upper abutment arm, and the location of the lower abutment arm along with the bottom-most machining head travel stop position is set by the lower abutment arm. When at least the desired pre-slug retention groove machining starting position or height has been set during position-adjustable mounting of the stop, the stop is position-fixed to substantially immovably mount the stop to the machine thereby also fixing the starting position or height as well as the bottom-most stop position readying the machine for slug retention groove machining operation. When the stop is position fixed to the machine, the machining head travel limiting stop arm travels back and forth in the recess between the upper and lower abutment arms defining a range of machining head travel less than the maximum without any stop installed that not only more rapidly machines the groove but which limits the range of travel in a manner more conducive for use with thinner dies.

A third one of the stops preferably is an adjustable machining head travel range limiting stop where the distance between the upper and lower abutment arms is adjustable such that the extent of the recess in which the machining head travel limiting stop arm travel also is adjustable. In a preferred adjustable stop, one of the abutment arms, preferably the upper abutment arm, is equipped with an adjuster that enables such abutment arm distance and recess extent adjustment by providing an adjustable upper abutment arm that is movable relative to the lower abutment arm to adjust the pre-slug retention groove machining starting position or height of the machining head, tool and bit relative to the die cavity and cavity sidewall. The adjuster advantageously enables the pre-slug retention groove machining starting position or height and range of machining head travel to be adjusted after the adjustable stop has been position-fixed mounted to the machine. The adjuster preferably also provides a machining head drive that can be used to displace the machining head, tool and bit downwardly toward the die cavity and cavity sidewall including during machining of a slug retention groove into the sidewall. Where used as a drive, the adjuster can be used to repeatedly reciprocate the machining head, tool and bit between the narrowed or reduced machining head travel range of the adjustable stop in machining the slug retention groove. A preferred adjuster is an adjustably extensible post carried by the upper abutment arm that preferably is formed of a thumbscrew whose free end defines a position-adjustable upper abutment arm with the adjuster also equipped with a lock that fixes the new pre-slug retention groove machining starting position or height after being set.

The machine preferably also includes at least one vibration dampening arrangement that dampens, reduces, or otherwise isolates the sound normally produced and vibration normally transmitted when the machining head touches the removable, position-adjustable stop by preventing direct contact between the machining head and the removable, position-adjustable stop. By suppressing, preventing, reducing and/or minimizing such vibration and associated sound produced thereby, it enables an operator to actually hear the sound of the rotating bit contacting the cavity sidewall during groove machining and use that sound as acoustical feedback in carrying out groove machining in a manner that helps produce a slug retention groove having a more uniform groove depth throughout the length of the groove.

In one preferred embodiment, the slide arrangement has a vibration dampening arrangement disposed between the movable slide block and fixed slide block that contacts upper fixed arm to dampen and absorb vibrations that would have otherwise been produced if the movable slide block stop directly touches the upper fixed arm. Where the slide arrangement is equipped with a machining head return, the return preferably also includes or is equipped with such a dampening arrangement with a preferred return having a machining head return biasing element that preferably is a viscous damped spring that provides vibration dampening preferably along with vibration isolation and/or vibration absorption during slug retention groove machining.

In a preferred embodiment, the machine has a vibration dampening arrangement of elastomeric construction disposed in operable cooperation with the slide arrangement and installed in one of the stop mounted to the machine that provides vibration isolation, vibration dampening and/or vibration absorption to the machining head, tool and bit to prevent the slide arrangement from directly touching the upper fixed arm. A preferred vibration dampening arrangement is carried by the movable slide block, preferably by the machining head travel limiting stop arm, which provides vibration isolation, vibration dampening and/or vibration absorption during slug retention groove machining at least when the stop arm contacts or abuts against one of the abutment arms of the stop mounted to machine. In a preferred embodiment, the vibration dampening arrangement includes an elastomeric bumper received in a seat of the movable slide block, preferably a seat formed in the stop arm, which has upper and lower stop surfaces which respectively contact the upper and lower abutment arms of the mounted stop during machining head movement or travel.

The machine can be equipped with an imaging system that includes a camera that can be a microscope from which digital images or digital streaming video of a slug retention groove being machined into a cavity sidewall can be obtained for inspection of the groove including in real time during machining of the groove. The imaging system preferably includes a camera support with a magnetic mounting block having a camera-receiving cradle in which the camera is seated and positioned at a downward viewing angle into the die cavity pointed toward the cavity sidewall in which the groove is to be machined. The camera is attached to a shape-memory bendable, flexible cable, preferably a goose-neck cable, to a display of a processor-equipped device like a tablet, laptop, smartphone or the like held by an imaging system mounted on the machine. The imaging system preferably also has at least one light that illuminates the area of the cavity sidewall being imaged by the camera with a preferred light being a spotlight with an elongate shape-memory positionable, bendable and flexible cable, preferably a goose-neck, cable connected to a source of electrical power onboard the machine that enables the position, angle and distance of the light from the cavity sidewall and camera to be set and maintained during slug retention groove machining.

DRAWING DESCRIPTION

The drawings illustrate at least one preferred embodiment presently contemplated for carrying out the invention. In the drawings.

Figure 6:
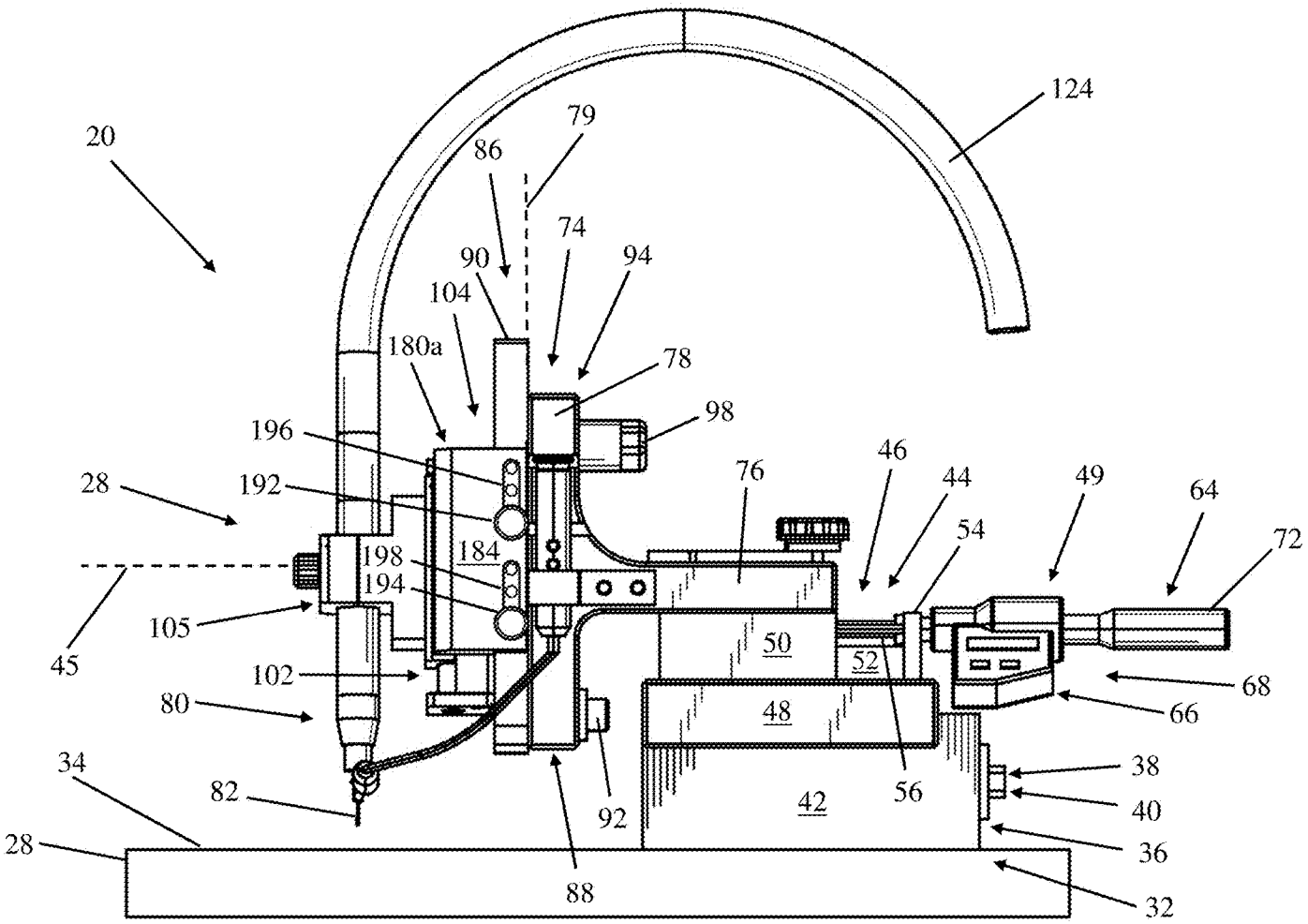
Figure 7:
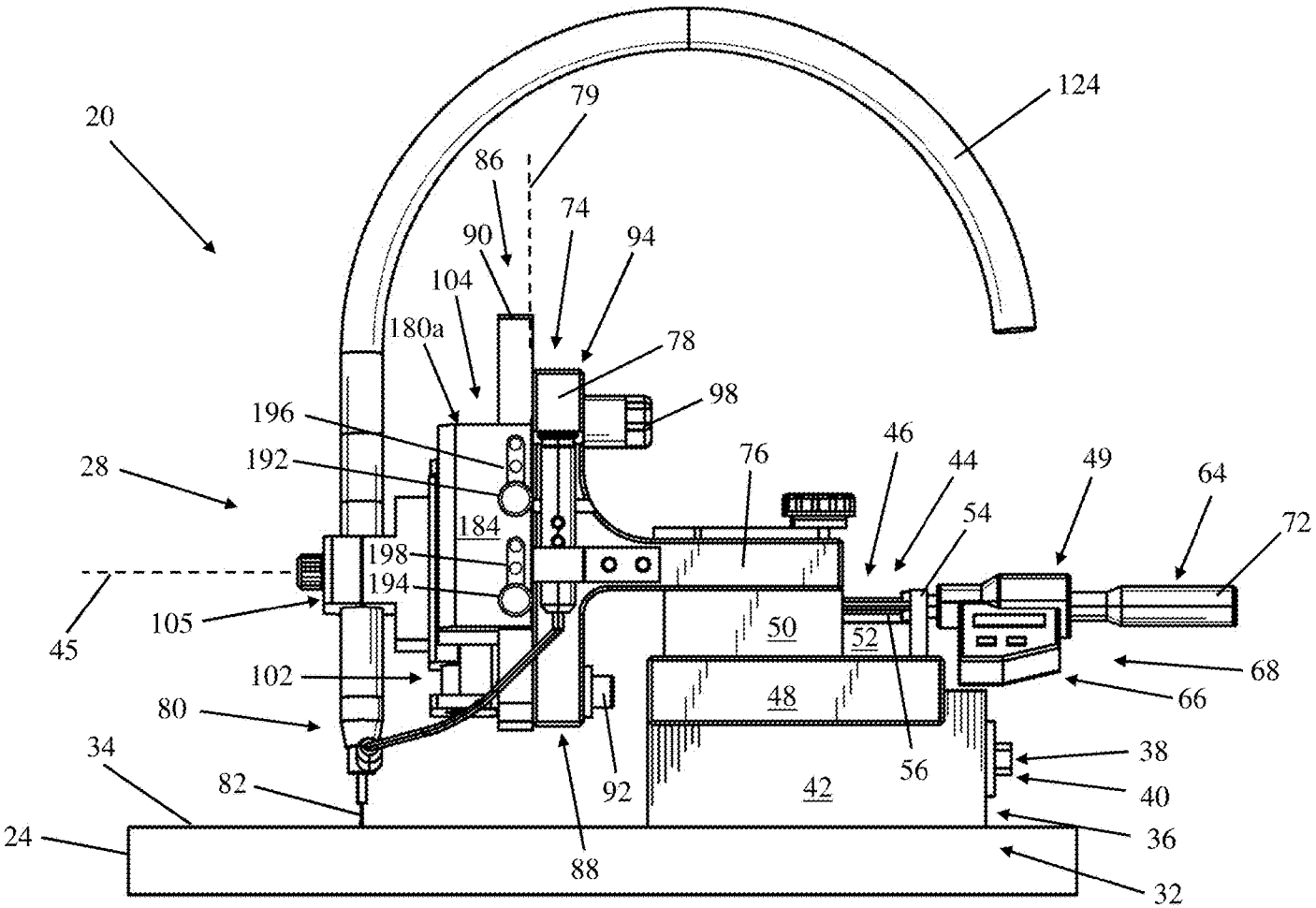
Figure 8:
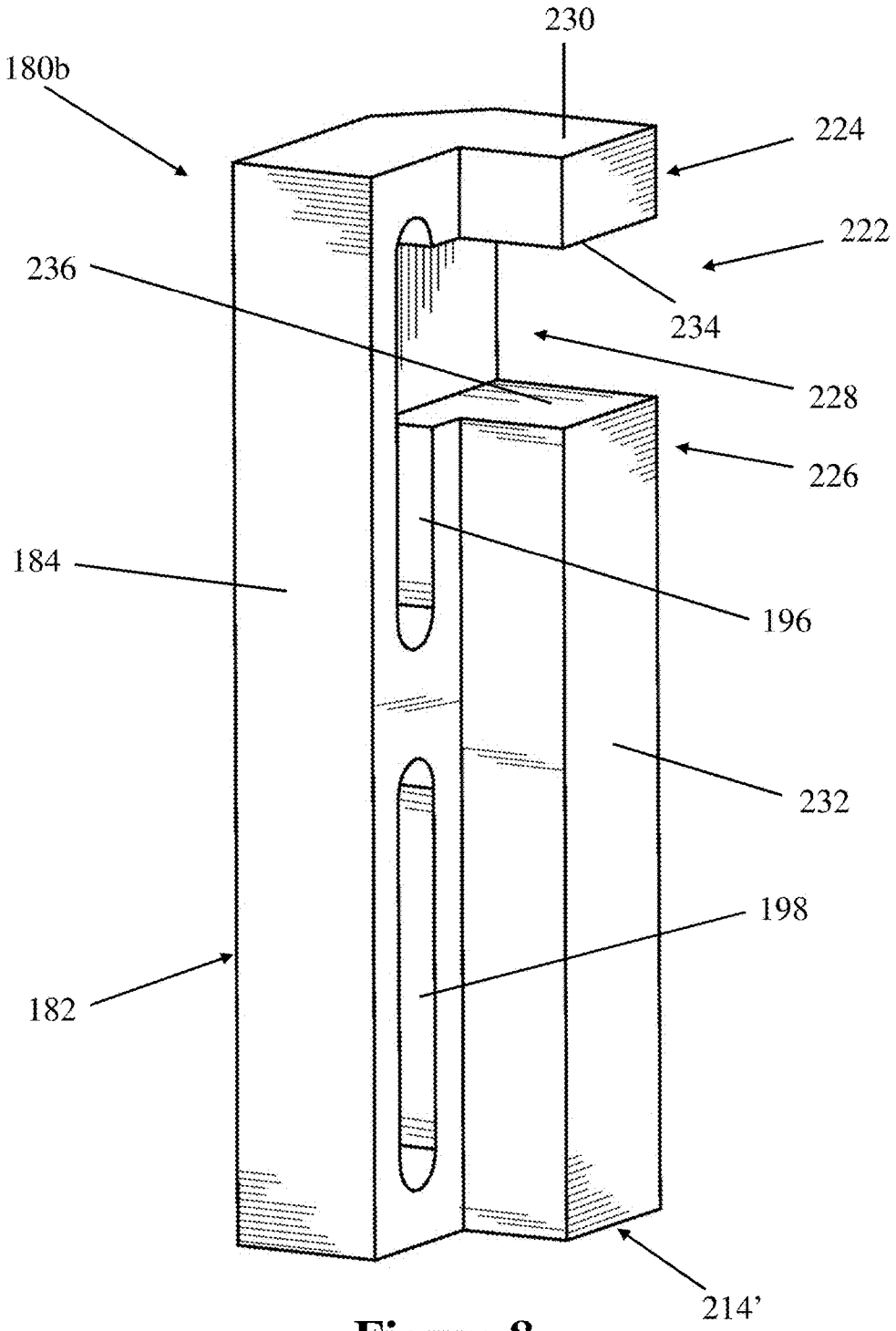
Figure 9:
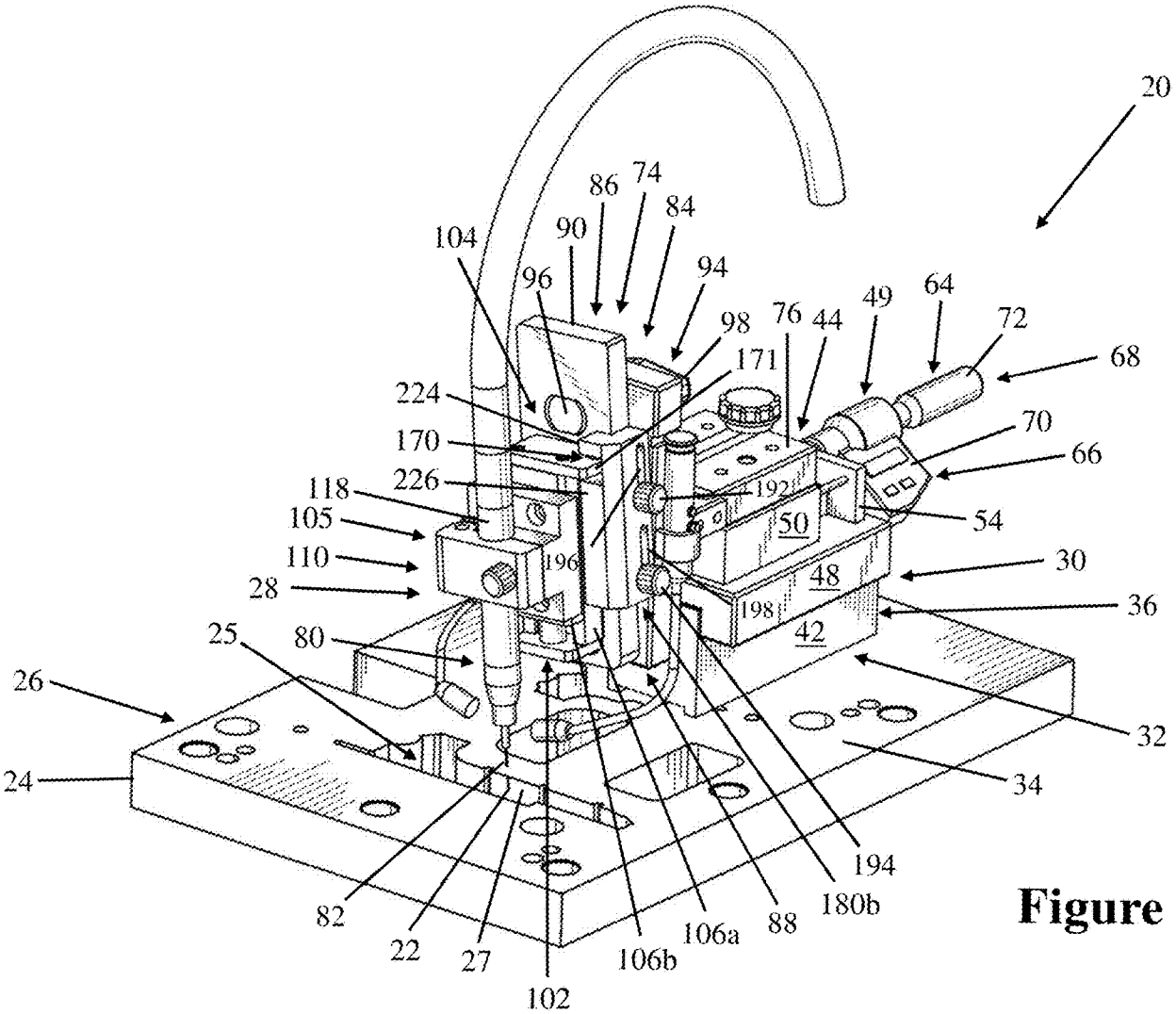
Figure 10:
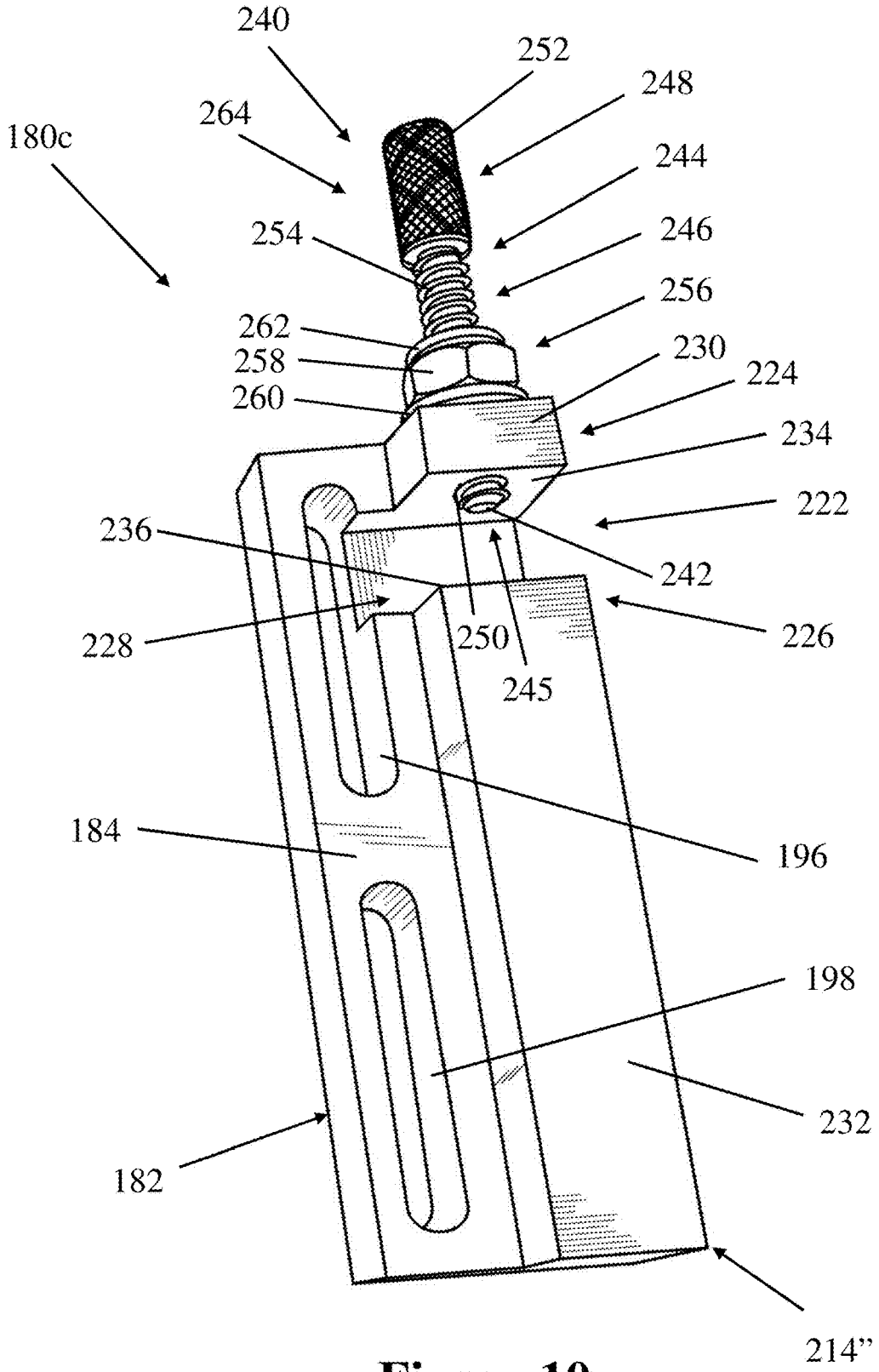
Figure 11:
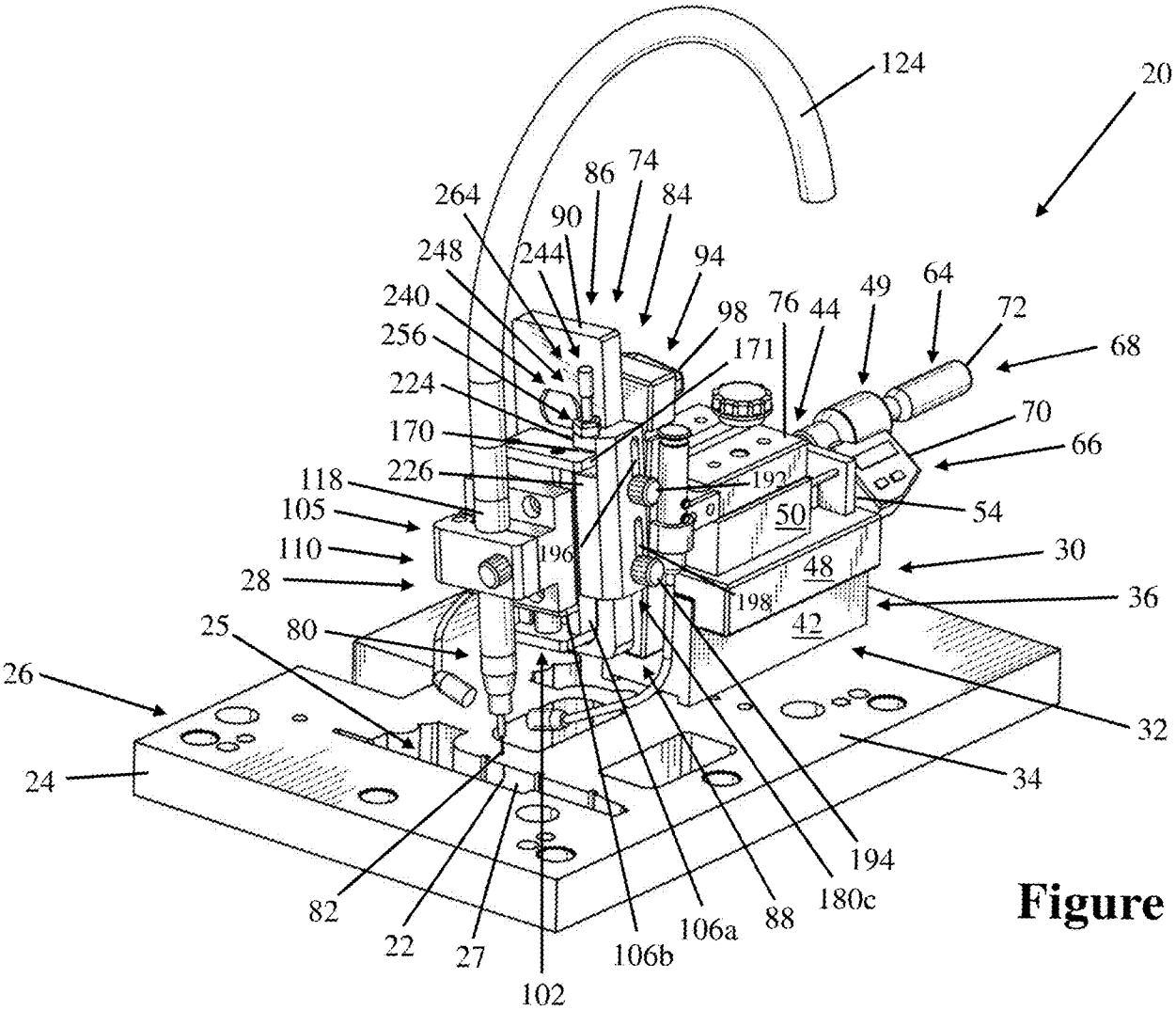
Figure 12:
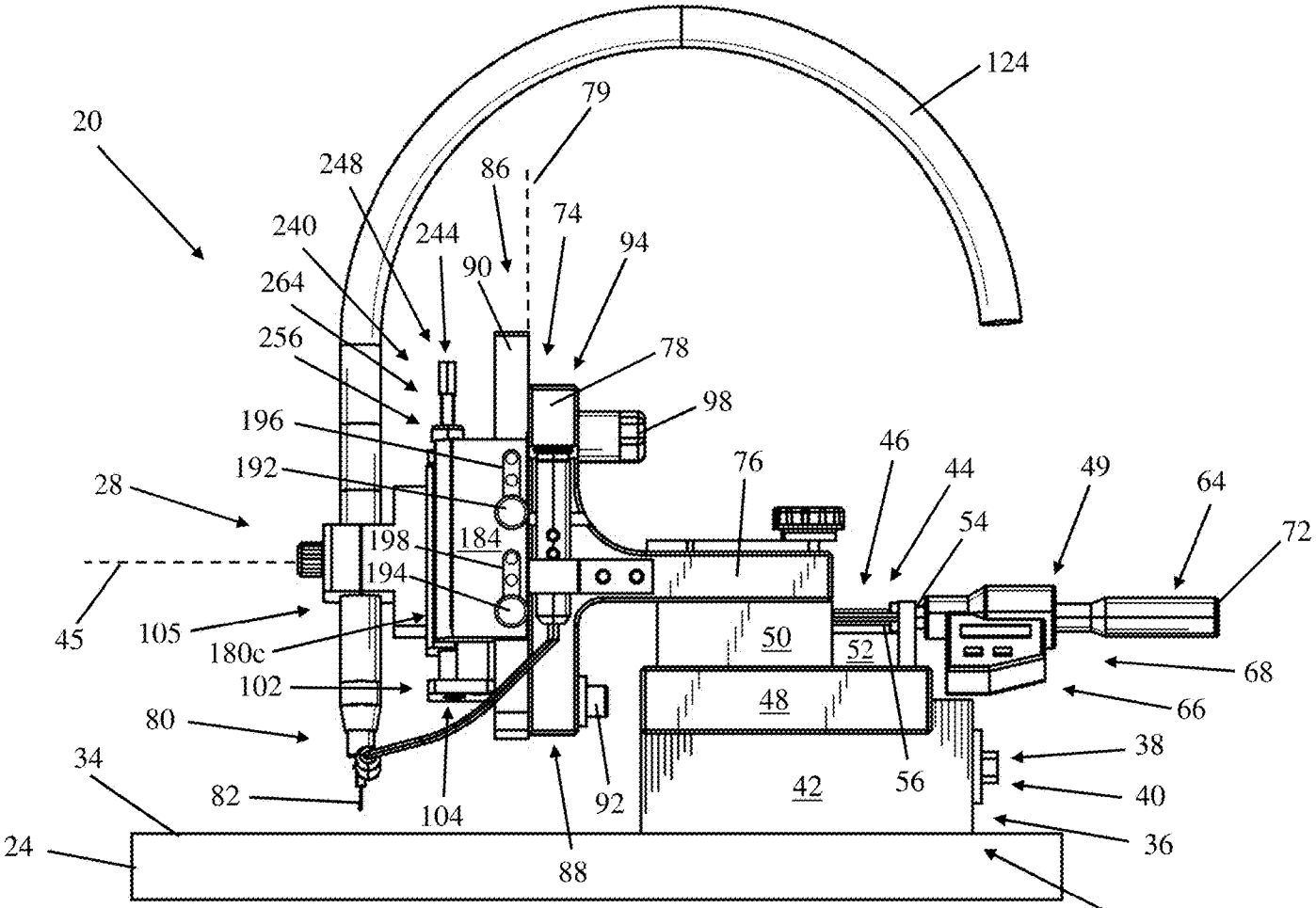
Figure 13:
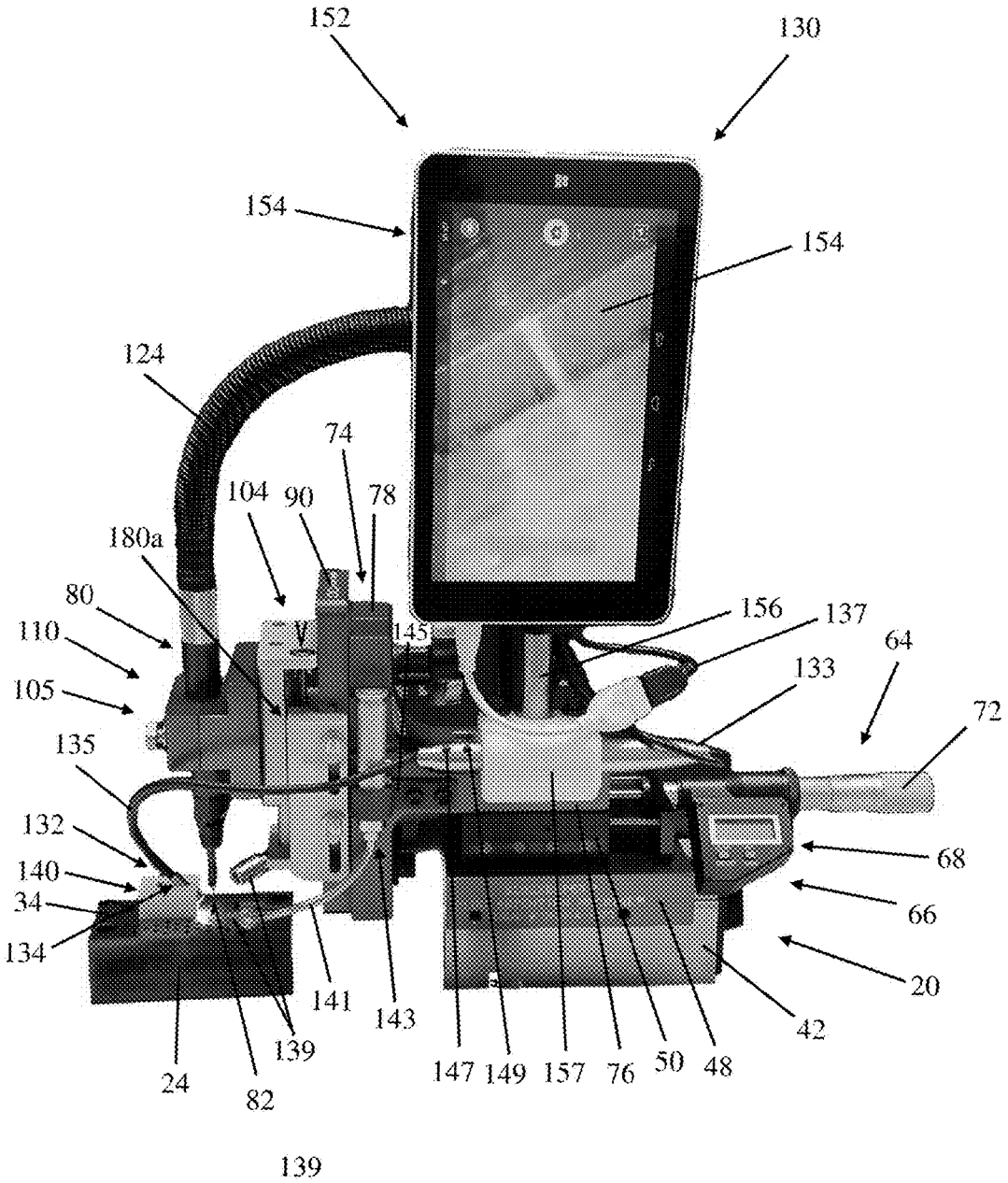
Figure 14:
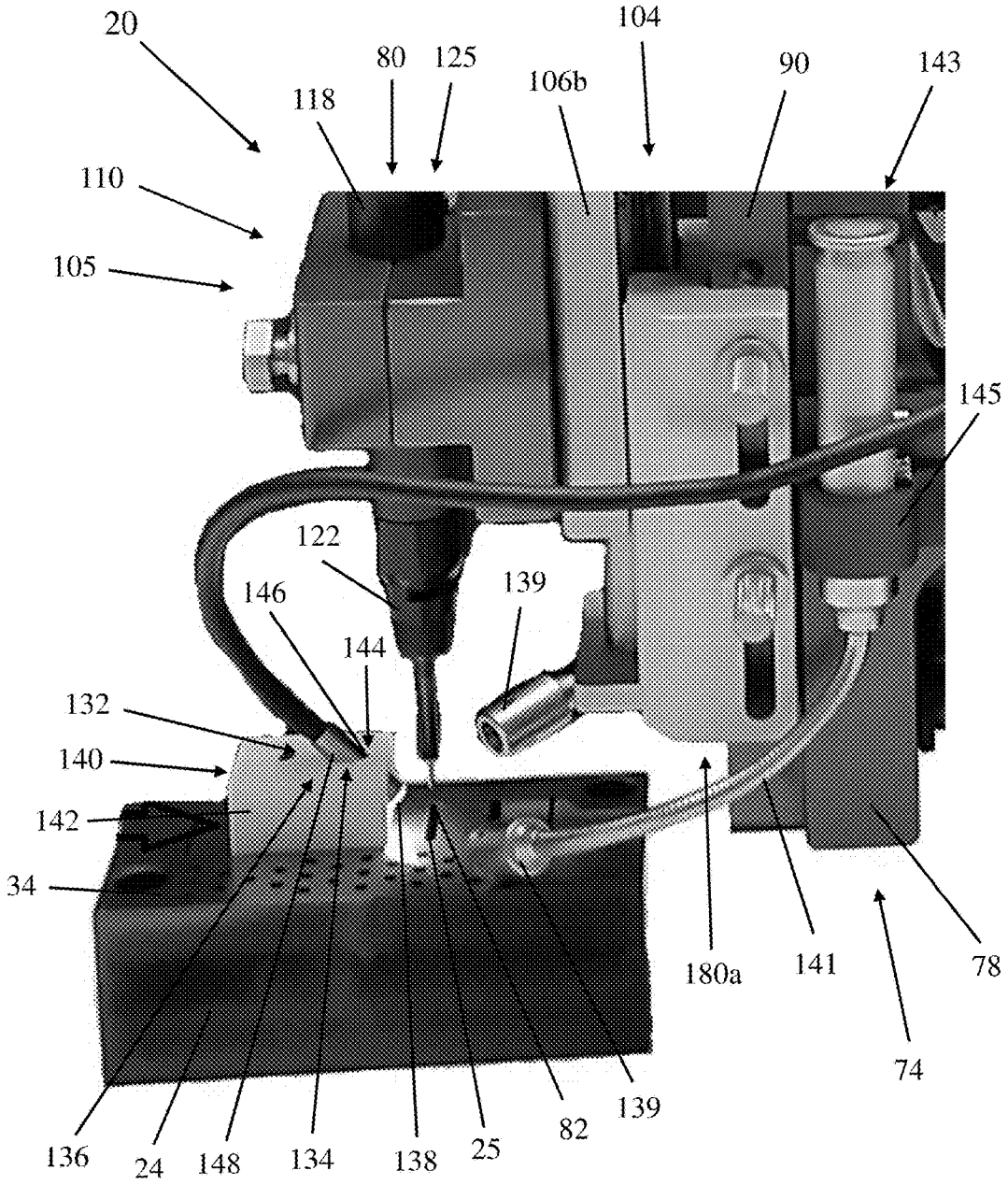

FIG. 6 is a first side elevation view of the slug retention groove forming machine with the first stop installed illustrating the machining head, slug retention groove machining tool carried by the machining head, and slug retention groove machining insert carried by the tool in a pre-slug retention groove starting position or height in preparation for machining a slug retention groove in a sidewall of a die cavity in a stamping press die;

FIG. 7 is a second side elevation view of the slug retention groove forming machine with the first stop installed illustrating the machining head, slug retention groove machining tool carried by the machining head, and slug retention groove machining insert carried by the tool in a maximum downward travel position illustrating a maximum range of travel of the head, tool and machining insert with the first stop installed;

FIG. 8 is an enlarged rear perspective view of a second preferred embodiment of a slug retention groove machining head motion limiting stop providing a pair of spaced apart machining head travel limiting abutments that define a fixed range of travel of the machining head, tool and machining insert travel that is less than a maximum range travel with no stop installed;

FIG. 9 is a front right perspective view of the slug retention groove forming machine with the second stop installed;

FIG. 10 is an enlarged rear perspective view of a third preferred embodiment of a slug retention groove machining head motion limiting stop providing an adjustable abutment spaced from a fixed abutment defining an adjustable range of travel and starting position or height of the machining head, tool and machining insert;

FIG. 11 is a front top perspective view of the slug retention groove forming machine with the adjustable third stop installed;

FIG. 12 is a side elevation view of the slug retention groove forming machine of FIG. 11 with the adjustable third stop installed;

FIG. 13 is a side perspective view of the slug retention groove forming machine with a slug retention groove imaging and inspection system installed that includes a camera carried by a base of a support mounted on an outer surface of a die adjacent the die cavity and cavity sidewall providing imaging and/or video of the die cavity and cavity sidewall including during slug retention groove machining enabling groove machining adjustments and inspection of the machined groove to be performed; and FIG. 14 is an enlarged fragmentary side perspective view of a portion of the machining head and die illustrating the various components of the imaging and inspection system.

Before explaining embodiments of the invention in detail, it is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION

FIGS. 1-14 illustrate a slug retention groove forming machine 20, also known as a slug keeper machine, along with various features and the like configured for use with such a slug retention groove forming machine 20 constructed in accordance with the present invention that is used to modify a die cavity or die opening 25 of a stamping die 24 in a manner that helps prevent pulling of blanks or slugs (not shown) created during operation of a stamping press 26. In the preferred slug retention groove forming machine embodiment shown in FIGS. 1-8, the machine 20 is configured to machine one or more slug retention grooves 22 in a sidewall 27 that forms at least part of the stamping die cavity or opening 25 that help prevent pulling of a slug created during operation of the stamping press 26.

Both the stamping die 24 and the stamping press 26 can be of conventional construction with the die 24 configured to cut, form or cut and form blanks, e.g., stamp parts, components, or the like, from a sheet of material that typically is of metallic construction, e.g., steel sheet, aluminum sheet, copper sheet, or the like. Stamping die 24 can also include or be constructed with one or more of a top die shoe, top thrust plate, punch holder plate or punch plate, punch, stripper backing plate, stripper plate, die plate, die backing plate, lower die shoe and/or guide pillar and brush, all of which are not shown in the drawings.

A slug retention groove forming machine 20 constructed in accordance with the present invention is compact, lightweight and therefore advantageously transportable enabling the machine 20 to be transported and used out in the field on a stamping die 24 installed in a stamping press 26 without having to remove the die 24 from the press 26. The slug retention groove forming machine 20 is advantageously adjustable along a plurality of axes enabling relatively precise adjustment of a machining head 28 of the machine 20 relative to the die 24 which is going to be modified by machining at least one slug retention groove 22 in die cavity sidewall 27 using the machine 20. The machine 20 is configured so that the head 28 is adjustable along a plurality of axes in a manner that enables the depth and angle of each groove 22 machined into a single die 24 to be precisely set or controlled.

A preferred slug retention groove forming machine 20 constructed in accordance with the present invention has a motion limiter 164 that limits the maximum distance of downward travel of the machining head 28 in a direction toward and/or into the die cavity 25 when no stop 180*a*, 180*b* or 180*c* is installed helping to enable relatively precise and uniform machining of slug retention groove 22. As discussed in more detail below, the machine 20 can include or be used with one of a plurality, preferably a plurality of pairs, i.e., at least three, of removable machining head motion constraining stops 180*a*, 180*b* and/or 180*c* that are adjustably mountable to the machine 20 and which are each configured to further constrain or limit travel of the head 28 in a direction toward and/or away from die cavity 25, including during forming of groove 22. At least one of the stops 180*a*, 180*b*, and/or 180*c*, preferably at least a plurality of the stops 180*a*, 180*b*, and/or 180*c* and preferably all of the stops 180*a*, 180*b* and 180*c*, e.g., at least a plurality of pairs, i.e., at least three, of the stops 180*a*, 180*b* and 180*c* are constructed and arranged to constrain or limit travel of the head 28 in a direction toward and/or into die cavity 25 during machining of groove 22 to a distance less than the maximum distance of travel of the head 28 preset by the motion limiter 164 when no stop 180*a*, 180*b*, or 180*c* is used.

Figure 1:
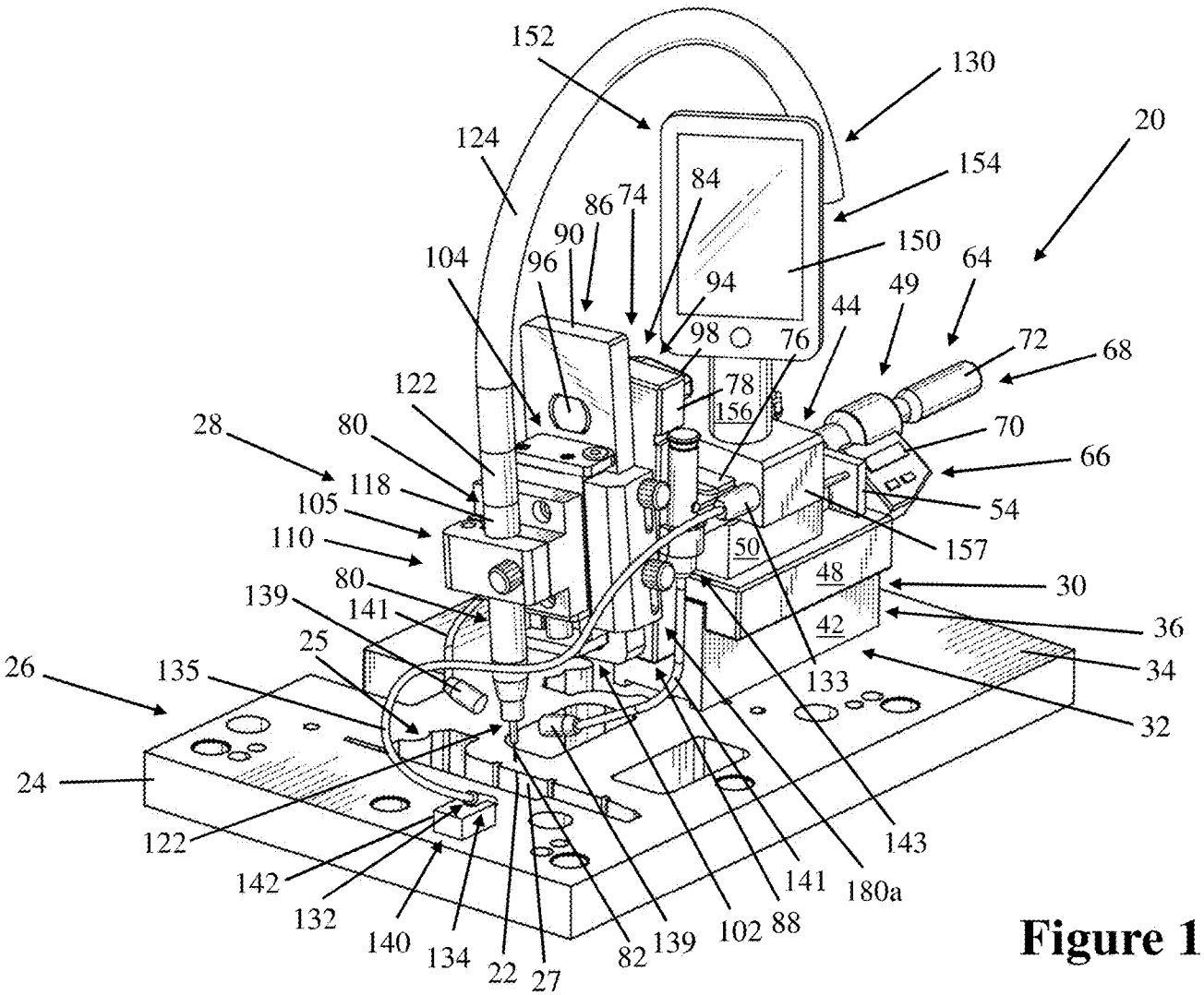
FIG. 1 is a front top perspective view of a slug retention groove forming machine with a first embodiment of a slug retention groove machining head motion limiting stop constructed in accordance with the present invention.

With reference to FIG. 1, the machine 20 has a base 30 offset from the machining head 28 enabling the machine 20 to stably rest upon the base 30 in a manner that desirably generally positions the head 28 relative to stamping die 24 that is going to be modified with a slug retention groove 22 using the machine 20 to prevent slug pulling during stamping. The slug retention groove forming machine base 30 is constructed and arranged to enable the slug retention groove forming machine 20 to be stably anchored in place wherever the machine 20 is used. In the preferred slug retention groove forming machine 20 shown in the drawing figures, the base 30 includes a mount 32 configured for releasable mounting on a surface 34, e.g., a flat or generally planar surface, which can be an outer or top surface of a die 24 mounted in a stamping press 26 or a die resting on a work holding surface of a tool room (not shown) advantageously enabling a preferred embodiment of a slug retention groove forming machine 20 of the present invention to be portable or transportable such that it can be used nearly anywhere.

In one embodiment, the machine mount 32 is a magnetic mount 36 configured for releasable mounting to a magnetically attractive mounting surface 34 that can be the outer or top surface of a die 24 mounted in a stamping press 26 or a magnetically attractive workholding surface, e.g., workbench or table, located in a tool room (not shown) where the die 24 is being prepared for use in a stamping press 26. With reference to FIG. 1, such a magnetic mount 36 can include an actuator 38, such as a lever or knob 40, used to magnetically yet releasably attach the mount 36 to the magnetically attractive mounting surface 34 securely and stably mounting the machine 20 thereto so its base 30 will not move or slip during operation.

Where the mount 32 is a magnetic mount 36, mount 36 includes a source of magnetic flux (not shown) or magnetic field that emanates from at least a portion of the mount 36, which can be produced using one or more permanent magnets or by employing one or more electrically energized electromagnets. In one embodiment, one or more permanent magnets, such as one or more rare earth magnets, e.g., Alnico magnets, neodymium magnets, or the like, are disposed within a generally rectangular boxlike outer housing 42 of the magnetic mount 36 and movable relative to the housing 42 toward or away from the magnetically attractive mounting surface 34 in response to manipulation of the actuator 38. When the magnet(s) of the magnetic mount 36 are moved toward the magnetically attractive outer surface 34, the magnets are positioned close enough to the surface 34 producing a strong enough magnetic attraction with the surface 34 that immovably anchors the machine 20 in place to the surface 34. When the magnet(s) of the mount 36 are moved far enough away from the mounting surface 34 that magnetic attraction with the surface 34 is minimized, the machine 20 can be grasped and lifted free of the mounting surface 34 enabling the machine 20 to be transported elsewhere.

Where the actuator 38 of the magnetic mount 36 is a knob 40, such as the knob 40 shown in FIG. 6, knob 40 can be manually turned or rotated by a user of the machine 20 between a mounting position where the machine 20 is magnetically mounted to a magnetically attractive mounting surface 34 and a release position enabling the machine 20 to be lifted free of the surface 34 and moved to another location. Where the magnetic mount 36 uses one or more electromagnets, knob 40 can function as a switch or operate a switch that selectively electrically energizes or de-energizes the electromagnets as needed to releasably yet immovably mount the machine 20 to the mounting surface 34.

With continued reference to FIG. 6, the base 30 carries a first slide 44 used to move the machining head 28 along a first axis 45 shown as a dashed line that preferably is generally parallel to the mounting surface 34, e.g., the top or outer die surface 34, and generally perpendicular or orthogonal relative to a die cavity 25 (FIG. 1) formed in the die 24 which the machine 20 is going to be used to modify to provide slug retention. In the preferred embodiment of the machine 20 shown in the drawing figures, the first slide 44 is a horizontal slide arrangement 46 carried by a base plate 48 that is attached to the mount 32, such as by one or more fasteners, e.g. bolts, or the like.

With additional reference to FIGS. 6, 7, and 12, the horizontal slide arrangement 46 includes a drive 49 that moves a slide plate 50 relative to the base 30 enabling the position of the machining head 28 to be moved generally horizontally relative to the base 30 after mounting the machine 20 to the mounting surface 34. Slide arrangement 46 also includes an anchor plate 52 fixed to the base 30, such as via one or more fasteners, e.g. bolts, or the like. The slug retention groove forming machining head horizontal positioning drive 49 cooperates with a slide plate stop 54 from which a generally horizontally extending drive piston or shaft 56 (FIGS. 6 and 7) outwardly extends that is attached to the slide plate 50. Slide arrangement 46 includes a pair of generally horizontally extending laterally spaced apart generally guides, e.g., elongate guide rods, which slidably cooperate with the slide plate 50 to slidably guide horizontal movement of the slide plate 50 relative to the base 30, anchor plate 52, and slide plate stop 54.

The slug retention groove forming machining head horizontal positioning drive 49 includes a drive actuator 64 that operatively cooperates with the drive shaft 56 to cause horizontal movement of the slide plate 50 relative to the base 30, anchor plate 52, and slide plate stop 54 (and relative to the outer surface 34 of the die 24 to which the machine 20 is releasably mounted). In a preferred horizontal slide arrangement 46, the drive 49 includes or cooperates with a position indicator 66, e.g., relative position indicator, such as in the form of a micrometer 68 having a user viewable digital display 70 as depicted in FIG. 1 that is capable of displaying relative horizontal slide movement or position to within 0.0001-inch accuracy enabling precise horizontal positioning of the machining head 28 to be done within 0.0001-inch accuracy. In another preferred embodiment, the micrometer 68 enables display of relative horizontal slide movement or position to within 0.001-inch accuracy enabling slug retention groove depth to be precisely controlled to within 0.001-inch accuracy. The micrometer 68 also includes one or more controls depicted in FIG. 1 as spaced apart push buttons which enable a position value to be reset and/or a relative position value to be set during positioning of the head 28 using the slide 44. In a preferred embodiment, the micrometer 68 is a micrometer modified operatively couple a manipulable knob 72 to the drive shaft of the horizontal machining head positioning drive 49 while being able to measure movement of the slide plate 50 when the knob 72 is rotated. For example, the shaft of the knob 72 can be directly connected to the drive shaft of the horizontal machining head positioning drive 49 or indirectly coupled to the drive shaft of the horizontal machining head positioning drive 49 such as by gearing or the like.

In the preferred slug retention groove forming machine embodiment shown in the drawings, the drive actuator 64 includes such a manipulable knob 72 that is rotated in one direction to cause the slide plate 50 to move generally horizontally relative to the base 30, anchor plate 52, and slide plate stop 54 in one direction and that is rotated in an opposite direction to cause the slide plate 50 to move generally horizontally relative to the base 30, anchor plate 52, and slide plate stop 54 in the opposite direction. Where a manipulable knob 72 is used, rotation of the knob 72 rotates the drive shaft of the horizontal machining head positioning drive 49 which in turn displaces the slide plate 50 relative thereto causing the slide plate 50 to move relative to the base 30, anchor plate 52 and slide plate stop 54.

Where the horizontal machining head positioning drive 49 employs a drive shaft that is rotary drive shaft, the rotary drive shaft can include or otherwise cooperate with a screw (not shown) disposed in engagement or operative cooperation with the slide plate 50 enabling relative rotation of the shaft of drive 49 to displace the slide plate 50 relative to the shaft of drive 49. Where the horizontal machining head positioning drive 49 employs a screw type drive arrangement, it can be or otherwise include a ball screw or the like that translates rotation of the drive shaft of the drive 49 into relative movement of the slide plate 50 in positioning the head 28 generally horizontally relative to the desired die cavity 25 of the die 24 sought to be modified to provide slug retention.

The horizontally displaceable slide plate 50 of the horizontal slide arrangement 46 moves a machining head carriage 74 substantially in unison therewith. The carriage 74 includes a carriage mount 76 carried by the slide plate 50 and a machining head support 78 oriented generally perpendicularly or orthogonally relative to the direction of motion of the slide arrangement 46. As is shown in the drawing figures, the machining head support 78 extends generally vertically relative to the slide plate 50 with the carriage mount 76 extending generally outwardly from the machining head support 78 overlying at least a portion of the slide plate 50.

In the preferred slug retention groove forming machine embodiment shown in the drawing figures, the machining head carriage 74 is generally T-shaped with the carriage mount 76 extending generally horizontally outwardly from a generally vertically extending machining head support 78. The carriage mount 76 is a generally rectangular plate that overlaps part of the slide plate 50 with the mount 76 attached to the slide plate 50 using a plurality of fasteners, e.g., bolts, or the like. The machining head support 78 is a generally rectangular plate extending generally perpendicularly or orthogonally to the carriage mount 76.

The machining head 28 is of adjustable construction being configured to adjustably position a slug retention groove machining tool 80 of the head 28 relative to the die 24. The tool 80 has a slug retention groove machining insert 82 that preferably is a rotary grinding or cutting bit 82 that is used to engage and machine a slug retention groove 22 in a sidewall 27 of a die cavity 25 of a stamping die 24 during use and operation of the machine 20. The head 28 is adjustably mounted to the carriage 74 in a manner that permits positioning of the tool 80 along a second axis 79, such as the generally vertical axis 79 depicted in FIGS. 6-7, which is generally perpendicular or orthogonal to the first axis 45, such as the generally horizontal axis 45 shown in FIGS. 6-7, thereby enabling the tool 80 to be moved relative to the die 24 toward or away from the cavity 25 of the die 24. The head 28 preferably also is angularly adjustable enabling the slug retention groove machining bit 82 of the tool 80 to be selectively oriented at a manually set or predetermined acute angle relative to the vertical axis 79 to cause the bit 82 to machine a groove 22 in the sidewall 27 of the die cavity 25 that is correspondingly acutely angled relative to the vertical axis 79.

Where the head 28 is angularly adjustable, an angular adjustment mechanism 84 is employed that includes a swivel assembly 86 in operative cooperation with the machining head support 78 that permits swiveling of at least part of the head 28 relative to the die 24 to orient the slug retention groove machining bit 82 of the tool 80 at a desired acute angle, a, relative to vertical axis 79 before machining groove 22 in sidewall 27 of cavity 25 of die 24 in performing slug retention modification of the die 24. The swivel assembly 86 includes a swivel 88 carrying the head 28 that is pivotally attached to the machining head support 78 and which can be releasably retained in the desired angular position once the desired angular orientation is set by a user.

Swivel 88 includes an elongate generally vertically extending swivel plate 90 pivotally attached by a pivot 92, e.g., pivot bolt, to a bottom portion of the machining head support 78 at or adjacent a bottom end of the swivel plate 90. The swivel plate 90 is releasably retained in a desired angular orientation by a clamp 94 that includes an angle adjustment post 96 extending from the swivel plate 90 rearwardly through a generally transversely or horizontally extending elongate angle adjustment slot (not shown) formed in the machining head support 78 that is threadably engaged with an angular adjustment clamping knob 98. When a desired acute angle of the machining bit 82 relative to vertical axis 79 is set, the angular adjustment clamping knob 98 is releasably tightened by a user of the machine 20 to substantially immovably clamp the plate 90 to the machining head support 78 thereby releasably fixing the plate 90 and bit 82 in the desired angular position. Although not shown, the angular adjustment mechanism 84 can include a scale or indicator that helps a user of the machine 20 to accurately visually set the angle of the bit 82.

While the angle adjustment slot preferably is formed in the machining head support 78, the slot can also be formed in the swivel plate 90 if desired. While the pivot 92 is disposed below the slot, it is contemplated that the swivel assembly 86 can be oriented differently, such as by being oriented oppositely with the pivot 92 disposed above the slot such that a modified swivel assembly would be oriented upside down from that shown in the drawing figures.

A second slide 102 carries the machining head 28 enabling movement of the head 28 and the groove machining tool 80 relative to the die 24 in a direction toward or away from the die 24. In the preferred slug retention groove forming machine embodiment shown in the drawing figures, the second slide 102 enables the head 28 to be moved along the second axis 79 that is generally perpendicular to the first axis 45 along which the first slide 44 allows machining head movement. In a preferred embodiment, the second axis 79 is generally parallel to the direction a punching die would travel in stamping a slug from a sheet of metal on the die 24 being stamped in the stamping press 26.

Figure 2:
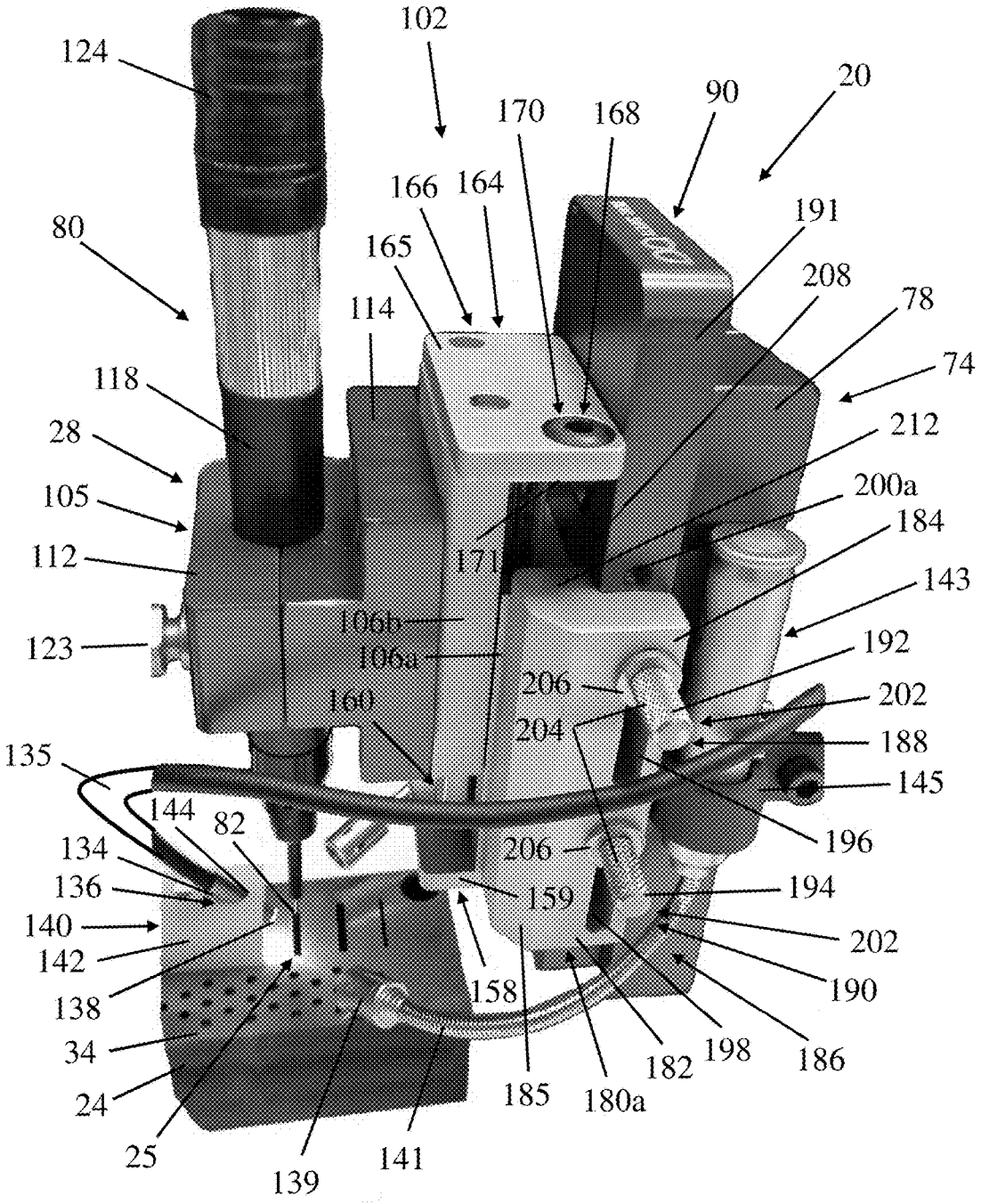
FIG. 2 is a fragmentary top left side perspective view of the slug retention groove forming machine of FIG. 1 illustrating the first slug retention groove machining head motion limiting stop in more detail.
Figure 3:
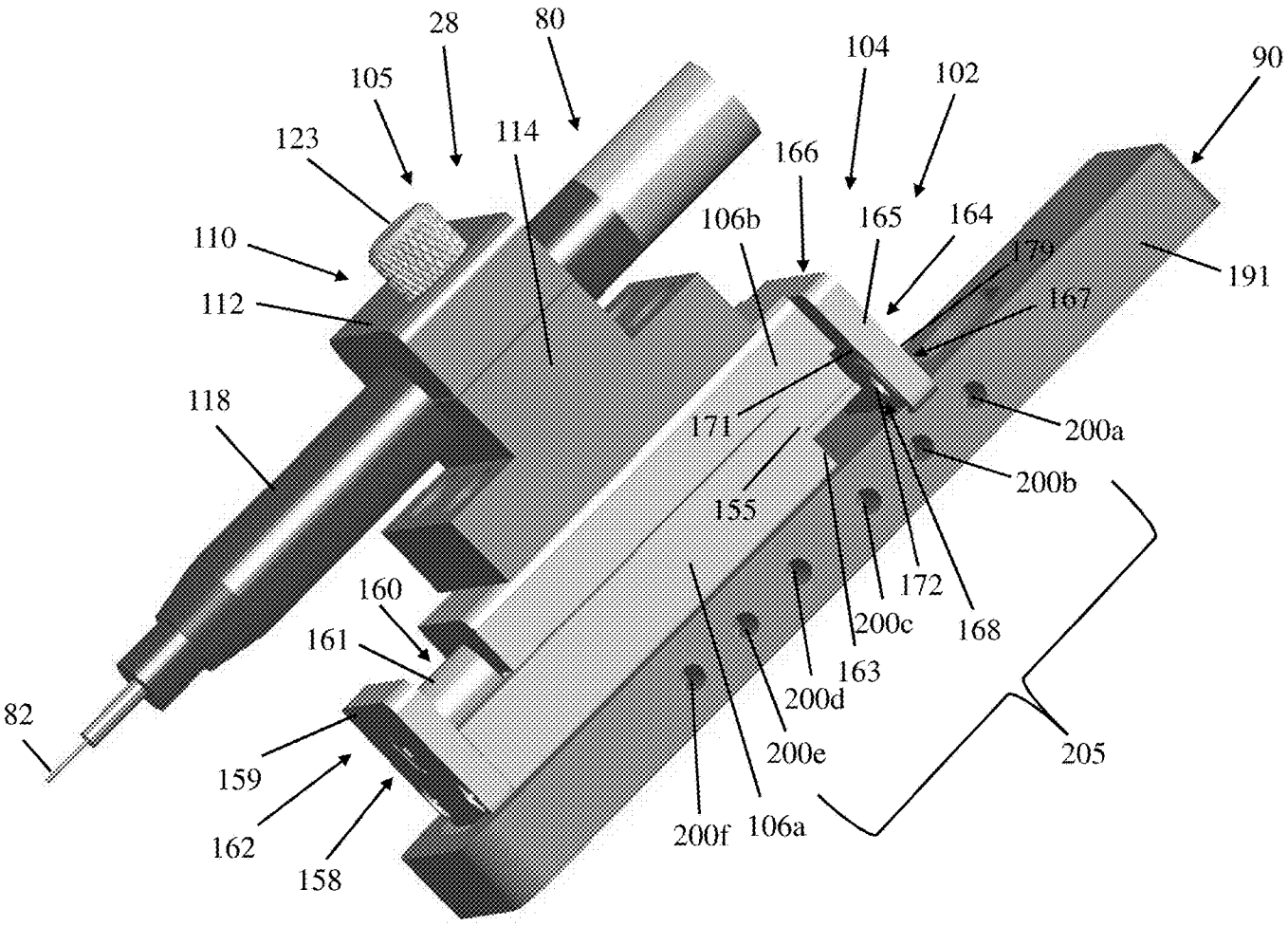
FIG. 3 is a fragmentary left side perspective view of the slug retention groove forming machine with no slug retention groove machining head motion limiting stop installed illustrating a maximum range of machining head travel when no stop is installed.
Figure 4:
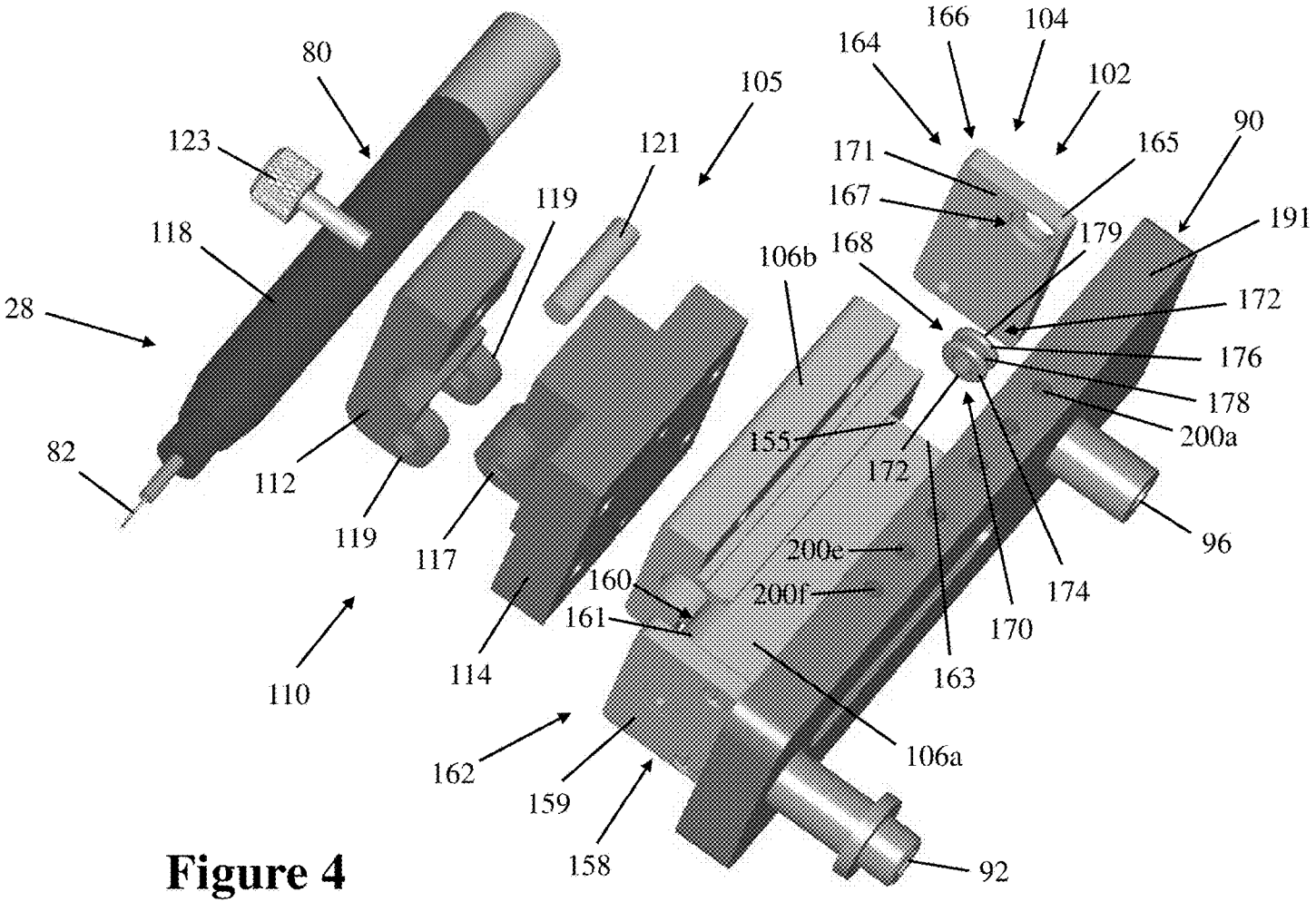
FIG. 4 is an exploded fragmentary left side perspective view of the slug retention groove forming machine of FIG. 3 with no slug retention groove machining head motion limiting stop installed.

In the preferred embodiment shown in the drawing figures, the second slide 102 is a machining head slide arrangement 104 formed of a slide block arrangement as shown in FIGS. 2-4 that includes a front movable slide block **106*b* that is movably coupled, preferably slidably coupled, to a rear slide block 106*a* that is fixed to the swivel plate 90, which is in turn grounded to the machining head carriage 74 when the angular adjustment clamping knob 98 is tightened. The movable slide block 106*b* carries a tool holder 105 of the machining head 28 that releasably holds the groove machining tool 80 enabling the tool holder 105, tool 80 and machining bit 82 of the tool 80 to be moved in a direction toward or away from a cavity 25 of a die 24 to be modified with a groove 22 using machine 20**.

With continued reference to FIGS. 2-4, the tool holder 105 is configured to releasably receive and frictionally retain the tool 80 in a manner that preferably also permits adjustment of a position, preferably a setup position, e.g., vertical setup position, of the tool 80 and its bit 82 relative to the cavity 25 of the die 24 to be slug retention groove modified before actual use of the machine 20. Where the base 30 of the machine 20 is mounted on a surface 34 of a die 24 that is generally horizontal, tool holder 105 releasably frictionally receives and holds the tool 80 in the holder 105 in a manner that permits the vertical position of the bit 82 and tool 80 relative to the die cavity 25 to be adjusted thereby enabling the vertical distance of the bit 82 and tool 80 from the cavity 25 to be adjustably preset before use of the machine 20 to form a groove 22 therein.

A preferred tool holder 105 is formed of a tool clamping assembly 110 composed of a pair of tool clamping blocks 112 and 114 which respectively engage opposite sides of a housing 118 of the of the tool 80 when the clamping assembly 110 is clamped closed releasably holding the tool 80 in the holder 105. The clamping blocks 112 and 114 are movable between a closed clamped position, such as the closed clamped position, e.g., closed or clamped position, shown in FIGS. 1-3, where the clamping blocks 112 and 114 releasably retain the tool 80, and an open position disposed from the closed position where one of the clamping blocks 112 is moved away from the other one of the clamping blocks 114 far enough to permit removal of the tool 80 from the tool holder 105. When disposed in the closed or clamped position, the clamping blocks 112 and 114 are releasably clamped together using a retainer that preferably is a fastener that more preferably is a thumbscrew 123 causing the clamping blocks 112 and 114 to frictionally engage opposite sides of a housing 118 of the tool 80 frictionally retaining the tool 80 in place. When disposed in an open position, the retainer, preferably fastener, more preferably thumbscrew 123 is disengaged from at least one of the clamping blocks, preferably disengaged from clamping block 114, permitting the other clamping block 112 to be moved away from the at least one clamping block 114 far enough to permit removal of the tool 80 from the holder 105.

With continued reference to FIGS. 2-4, one of the clamping blocks 112 is an outer tool clamping block 112 that is mounted by a hinge 115 to the other one of the clamping blocks 114 which is a generally T-shaped inner tool clamping block 114 that is fixed by fasteners (not shown) such as screws and/or bolts to the front slide block **106*b* for vertical movement in unison with the front slide block 106*b*. The hinge 115 extends along one side of the tool clamping assembly 110 and is formed by one of the clamping blocks 114 having a hinge knuckle 117 disposed between and generally coaxial with a pair of spaced apart and generally coaxial hinge knuckles 119 of the other one of the clamping blocks 112 that are pivotably interconnected by a hinge pin 121 that extends through the knuckles 117 and 119. The retainer, preferably fastener, and more preferably thumbscrew 123 is carried by one of the clamping blocks, preferably the outer clamping block 112, and threadably engages the other one of the clamping blocks, preferably the inner clamping block 114, when the clamping blocks 112 and 114 are disposed adjacent one another, preferably at or adjacent the closed or clamped position, enabling the clamping blocks 112 and 114 to be releasably retained in the closed clamped position. The retainer, preferably fastener, more preferably thumbscrew 123 has an elongate threaded stud that extends through a bore formed completely through the outer clamping block 112 that is threadably received in a threaded bore formed in the inner clamping block 114 threadably engaging the inner clamping block 114 during clamping of the blocks 112 and 114 in the closed position around the housing 118 of the tool 80**.

When disposed in the closed clamped position, the tool holder 105, namely its clamping assembly 110, is configured to enable the amount of clamping pressure applied by the clamping blocks 112 and 114 against the tool housing 118 to be selectively applied, e.g., selectively controlled, to enable the position of the housing 118, machining bit 82, and tool 80 along an axial or longitudinal direction of the tool 80 relative to the clamping blocks 112 and 114, the die 24 and the die cavity 25 to be adjusted and preferably preset in preparation for use of the machine 20. In a preferred embodiment, the retainer, preferably fastener, more preferably thumbscrew 123 is manipulated, preferably manually rotated, when engaged with both clamping blocks 112 and 114 clamped around the tool housing 118 to selectively apply an amount of clamping pressure to the housing 118 that is enough to hold the tool 80 in the tool holder 105 while enabling the tool 80 to be slidably moved relative to the clamping blocks 112 and 114 closer to or farther away from the die cavity 25 to a desired setup position prior to use of the machine 20. This advantageously enables the position of the machining bit 82 of the tool 80 relative to the die cavity 25 and the distance of the bit 82 away from the cavity 25 to be adjusted by moving the tool 80 relative to the tool holder 105 while the tool 80 is held by the tool holder 105 before the tool 80 is actually used.

In a preferred method of forming a slug retention groove 22 using a slug retention groove forming machine 20 constructed in accordance with the present invention, the thumbscrew 123 is selectively manipulated, preferably selectively manually rotated, in a manner that causes the clamping blocks 112 and 114 to selectively apply an amount of clamping pressure to the tool 80 that slidably movably clamps the tool 80 between the clamping blocks 112 and 114, the tool 80 is slidably axially moved relative to the clamping blocks 112 and 114 to a desired setup position that locates the bit 82 close enough to the die cavity 25 prior to use that will enable the rotating bit 82 to engage the sidewall 27 of the cavity 25 and form a groove 22 in the sidewall 27 during actual use of the machine 20. Once the movably slidably clamped tool 80 is slidably axially moved relative to the clamping blocks 112 and 114 and the die cavity 25 to such a desired setup position, the thumbscrew 123 is manipulated, preferably manually rotated, to increase the amount of clamping pressure applied by the clamping blocks 112 and 114 against the tool housing 118 until the tool 80 is substantially immovably and frictionally clamped in place therebetween preventing movement of the tool 80 relative to the clamping blocks 112 and 114 of the tool holder 105.

In other words, the thumb screw 123 can be tightened or loosened when the clamping blocks 112 and 114 are closed around the housing 118 to enable selective application of clamping pressure by the clamping blocks 112 and 114 against the tool 80 to permit the tool 80 to be slidably moved in the tool holder 105 relative to the clamping blocks 112 and 114 to position the bit 82 and tool 80 closer to or farther away from the die cavity 25 to be modified. After the tool 80 and bit 82 are moved closer to or farther away relative to the tool holder 105 to a desired vertical position relative to the cavity 25, the thumb screw 123 is manually tightened increasing clamping pressure applied by the clamping blocks 112 and 114 around housing 118 fixing the tool 80 in place thereby locking the position of the tool 80 and insert 82 relative to the tool holder 105 and die cavity 25.

When it is desired to completely remove the tool 80 from the tool holder 105, such as when it is desired to change the groove cutting bit 82, service the tool 80, or replace the tool 80 with a new or different tool, the thumb screw 123 is loosened until it disengages from the inner clamping block 114 enabling the outer clamping block 112 to be pivoted or swung away from the inner clamping block 114 opening the tool holder 105. When opened, tool 80 can be removed, serviced, and returned to the open tool holder 105, whose clamping assembly 110 can be manipulated to clamp the tool 80 in the holder 105.

When it is desired to mount the tool 80 in the tool holder 105, the outer clamping block 112 is swung like a door about pin 121 of hinge 115 away from the open position towards the closed clamped position shown in FIG. 1 until the outer clamping block 112 overlies and is disposed against the tool housing 118 and inner clamping block 114. The thumbscrew 123 is then manually rotated to threadably engage the thumbscrew 123 with the inner clamping block 114 and further tightened to selectively increase the amount of clamping pressure applied by the blocks 112 and 114 to the tool 80. Where position adjustment of the tool 80 is desired, the thumbscrew 123 is not completely tightened to apply enough clamping pressure to permit the tool 80 to be frictionally retained between the blocks 112 and 114 but allow the tool 80 to be slidably moved relative to the blocks 112 and 114 to position the tool 80 relative to the die cavity 25. Once the position of the tool 80 is set at the desired preset or setup position, the thumbscrew 123 is further tightened to apply even greater clamping pressure against the tool 80 that preferably is enough clamping pressure that the tool 80 is substantially immovably fixed or grounded thereto thereby substantially immovably fixing or grounding the tool 80 to the tool holder 105.

When the slug retention groove machining tool 80 is clamped in the tool holder 105 of the slug retention groove machining head 28, the machining head slide arrangement 104 permits movement of the head 28, tool 80, and bit 82 relative to the machine base 30 and carriage 74 of the slug retention groove forming machine 20 in a direction toward or away from the cavity 25 of the die 24 during use and operation of the machine 20. Where the base 30 of the machine 20 is mounted on a surface 34 of a die 24 that is generally horizontal, the machining head slide arrangement 104 extends generally vertically thereby permitting movement of the head 28, tool 80, and bit 82 relative to the base 30 and carriage 74 of the machine 20 generally vertically in a direction toward or away from the cavity 25 of the die 24 during use and operation of the machine 20.

As previously indicated, the tool 80 is mounted in the tool holder 105, which in turn is mounted to the outer slide block 106*b* of the vertical slide arrangement 104. The outer slide block 106*b* slidably engaged with the inner slide block 106*a* and the inner slide block 106*a* is fixed to the swivel plate 90. When the clamping knob 98 is tightened to set the angle of the head 28, the swivel plate 90 is fixed in place to the machining head support 78 thereby grounding the swivel plate 90 to the machining head carriage 74. When the knob 98 is tightened and the swivel plate 90 is fixed in place in a grounded condition, the inner slide block 106*a* also is grounded to the machining head carriage 74 as well as to the rest of the machine 20 including the machine base 30. Prior to machining of a slug retention groove 22 in the sidewall 27 of die cavity 25, the clamping knob 98 is tightened to fix the angle of the head 28 thereby grounding the swivel plate 90 and inner slide block 106*a* to the carriage 74 and base 30 which remain fixed in place or grounded during slug retention groove machining.

With continued reference to FIGS. 2-4, the vertical slide arrangement 104 has a slide base 158 that also is grounded during slug retention groove forming operation of machine 20 and which carries a machining head return biasing element 160 configured to urge the machining head 28 and tool 80 away from the die cavity 25 to automatically return the head 28 and tool 80 to the pre-slug retention groove machining setup position. The machining head return biasing element 160 preferably is a spring 161 preferably captured in compression between the slide base 158 and movable outer slide block 106*b* that resiliently urges the movable slide block 106*b* away from the slide base 158 thereby automatically causing the movable slide block 106*b*, head 28, tool 80 and bit 82 to return to the pre-slug retention groove machining setup position upon removal of any force urging the movable slide block 106*b*, head 28, tool 80 and bit 82 toward the die cavity 25. Where the machine 20 employs a machining head return spring 161, spring 161 can be and preferably is a gas spring, such as a pneumatic spring, or can be a coil spring. If desired, biasing element 160 can also include or operably cooperate with a damper arrangement, preferably an elastomeric damper, e.g., rubber damper, or viscous damper, which is a part of, carried by, or operatively connected thereto. Where the machining head return biasing element 160 is a gas spring 161, preferably a pneumatic spring, gas spring 161 preferably provides or is a dampener by providing damping, e.g., viscous damping, during gas spring operation in opposing downward travel of head 28, tool 80 and bit 82 toward and/or into die cavity 25 as well when returning the head 28, tool 80 and bit 82 back to its starting or return position.

The slide base 158 includes or is formed of a generally horizontal machining head return biasing element seating flange 159 that extends outwardly from one end, i.e., the bottom, of the fixed inner slide block 106*a*, e.g., generally L-shaped slide block 106*a*, and overlies a corresponding end, i.e., the bottom, of the movable outer slide block 106*b*. If desired, the biasing element seating flange 159 can be formed of a separate generally rectangular plate that is attached to the bottom of the generally rectangular inner slide block 106*a* by one or more fasteners, e.g., screws or bolts. The slide base 158 provides a seat for the machining head return biasing element 160 thereby locating the biasing element 160 between a top of the seating flange 159 and part of the movable outer slide block 106*b* interiorly disposed within the movable slide block 106*b*. The machining head return biasing element 160, preferably spring, more preferably gas spring 161, is elongate and extends longitudinally generally vertically between the outer slide block 106*b* and inner slide block 106*a* such that the biasing element 160 is interiorly housed within the slide arrangement 104 enclosed between slide blocks 106*a* and 106*b*. Collectively, the fixed inner slide block 106*a*, including the slide base 158, e.g., biasing element seating flange 159, the biasing element 160, e.g., spring 161, and the movable outer slide block 106*b* define an automatic machining head return 162 that automatically returns the head 28, tool 80, and bit 82 to the initial setup position after a downward force applied thereto during machining of groove 22 in die cavity sidewall 27 is removed.

As previously discussed, the machine 20 has a downward travel motion limiter 164 that limits motion of the head 28 in a direction toward the die cavity 25 in a manner that determines or defines a maximum distance of the travel for the head 28 and tool 80 to thereby limit the distance of travel of the machining bit 82 that actually contacts die cavity sidewall 27 during machining of groove 22 to a correspondingly same maximum distance of travel. The motion limiter 164 is configured to cause interference with ground to occur when movement of the head 28 and slide block 106*b* in a direction toward the die cavity 25 reaches the predetermined maximum distance of travel defined by motion limiter 164. The motion limiter 164 preferably is configured to cause or produce interference between part of the movable slide block 106*b* and ground when the slide block 106*b* reaches the position of maximum travel. In a preferred embodiment, motion limiter 164 is configured to produce such maximum travel machining head motion limiting interference by the machine 20 being constructed and arranged with a part of the movable slide block 106*b*, which can be a part that is carried by, e.g., attached to, the movable slide block 106*b*, being configured to abut or stop against another part of the machine 20 that is fixed or grounded to the base 30 of the machine 20 upon which the machine 20 is supported during formation of groove 22.

A preferred machining head downward travel motion limiter 164 includes or is defined at least in part by a machining head travel limiting stop arm 171 of the movable slide block 106*b* that stops or abuts against ground, e.g., a grounded part of the machine 20 fixed to machine base 30, when maximum travel of the movable slide block 106*b*, head 28, tool 80 and bit 82 in a direction toward and/or into die cavity 25 is reached during slug retention groove machining use and operation of machine 20. The motion limiter 164 further includes or is further defined by a grounded machining head downward travel limiting stop landing 163 against which part of the machining head travel limiting stop arm 171 interferingly abuts or stops when maximum travel of the movable slide block 106*b*, head 28, tool 80 and bit 82 in a direction toward and/or into die cavity 25 is reached.

The machining head downward travel limiting stop landing 163 is grounded, e.g., is part of ground, by being fixed to ground during slug retention groove forming use of the machine 20 by the stop landing 163 being fixed to part of the machine 20 that is ultimately fixed or grounded to machine base 30. In a preferred motion limiter embodiment, the stop landing 163 is provided or defined by at least a portion of an upper or top edge 155 of an opposite end, i.e., the top 155, of the fixed slide block 106*a*. Fixed slide block 106*a* preferably is grounded during movement of the movable block 106*b*, head 28, tool 80 and bit 82 by the fixed slide block 106*a* being fixed to swivel plate 90 which is in turn fixed in place to the machining head support 78 of the machining head carriage 74 which is fixed to the base 30.

In a preferred embodiment of a slug retention groove forming machine 20 constructed in accordance with the present invention, the vertical slide arrangement 104 includes such a machining head downward travel motion limiter 164 where the machining head motion limiting stop arm 171 is formed of or by at least a portion of an end cap 166 carried by the movable slide block 106*b* that extends outwardly of or from the slide block 106*b* and overhangs fixed slide block 106*a* enabling the stop arm 171 to make interfering contact with stop landing 163 when maximum downward travel toward and/or into die cavity 25 has been reached. The slide block cap 166, including stop arm 171, are formed of a cap plate 165 that preferably is rectangular and attached to an opposite end, i.e., top, of the movable slide block 106*b*.

The machining head travel limiting stop arm 171 preferably carries a resilient vibration damper arrangement 168 that also can be and preferably is an elastomeric bumper 170 retained in an annular seat 167. With continued reference to FIGS. 2-4, the bumper 170 preferably is a generally annular elastomeric bushing or grommet, e.g., rubber grommet, which is received in the bumper seat 167 with a lower machining head travel stop surface 172 of the bumper 170 making contact with the grounded machining head downward travel limiting stop landing 163 of the fixed slide block 106*a* when the stop arm 171 carrying the bumper 170 reaches the stop landing 163. Abutment or stopping of the stop arm 171 against the motion limiting downward travel stop landing 163 prevents movable slide 106*b*, head 28, tool 80 and bit 82 from moving any farther downwardly toward, into or through die cavity 25, including during slug retention groove forming operation of machine 20.

As previously noted, downward travel motion limiter 164 defines a maximum range or maximum distance of travel of the movable slide block 106*b*, head 28, tool 80, and bit 82 relative to the fixed slide block 106*a*, swivel plate 90, machining head support 78, machining head carriage 74, and machine base 30 downwardly toward die cavity 25 during forming a slug retention groove 22 in cavity sidewall 27. With continued reference to FIGS. 2-4, the bumper 170 preferably is a generally annular elastomeric bushing or grommet, e.g., rubber grommet, which is received in the bumper seat 167 with a lower machining head travel stop surface 172 of the bumper 170 disposed between the vertical slide cap 166 or cap plate 165 and the top 155 of the fixed inner slide block 106*a*. With reference to FIG. 4, a preferred bumper 170 is a round or circular rubber grommet formed of a pair of annular lobes 174 and 176 axially spaced apart to define a recessed seating channel 178 therebetween that receives part of the vertical slide cap 166 that defines an inner edge of the bumper seat 167 to securely retain the grommet in the seat 167.

The lower machining head travel stopping surface 172 of the bumper 170 faces generally downwardly toward the top 155 of the fixed slide block 106*a* abutting against the fixed slide block top 155 stopping farther travel of the movable slide block 106*b*, head 28, tool 80, and bit 82, when the movable slide block 106*b*, head 28, tool 80, and bit 82 of tool 80 have been urged downwardly toward the die cavity 25 during use and operation of the machine 20. When the lower stopping surface 172 is urged against the top 155 of the fixed slide block 106*a*, a portion of the bumper 170 remains disposed between the vertical slide cap 166 or cap plate 165 and the top 155 of the fixed slide block 106*a* preferably functioning as a spacer that prevents direct contact between the vertical slide cap 166 or cap plate 165 of the movable slide block 106*b* and the top 155 of the fixed slide block 106*a*. When disposed in contact with the top 155 of the fixed slide block 106*a*, the elastomeric bumper 170 preferably also is an isolator 168 that isolates the movable slide block 106*b* from the fixed slide block 106*a* thereby isolating the tool 80 and machining head 28 from the machining head carriage 74 and machine base 30.

Where the elastomeric bumper 170 serves as such an isolator 168, the bumper 170 preferably is, provides, defines or functions as a vibration isolator 168 that helps dampen vibration of the tool 80 and/or head 28 created during contact between the groove machining bit 82 and the die cavity sidewall 27 during forming slug retention groove 22 in the sidewall 27 during operation of the machine 20. Where the bumper 170 is such a vibration isolating or vibration absorbing damper arrangement 168 disposed between the fixed slide block 106*a* and movable slide block 106*b* when the head 28 is disposed in the position of maximum travel, the vibration isolation provided by bumper 170 advantageously helps prevent walking and/or chatter of the rotating bit 82 when the bit 82 is in engagement with sidewall 27 during machining of groove 22.

During use and operation of machine 20, the machining head 28 is urged downwardly from the initial setup position downwardly toward die cavity 25 until the stop surface 172 on the bottom of the bumper 170 abuts against a top portion of the fixed inner slide block 106*a*. When the lower stop surface 172 of the bumper 170 abuts against the top portion of the fixed inner slide block 106*a*, the bumper 170 acts as a soft, impact absorbing, vibration damping stop that not only prevents farther downward movement or travel of the head 28 but which preferably also prevents direct contact between the vertical slide cap 166 or cap plate 165 and the top of the fixed inner slide block 106*a*.

As discussed in more detail below, the machining head travel limiting stop arm 171 can also be employed to limit or reduce the distance of upward return travel of the machining head 28, tool 80 and bit 82 in a return travel direction away from the die cavity 25 by the stop arm 171 abutting or stopping against something disposed above the arm. Where the stop arm 171 is of bidirectional stop arm construction, e.g. is a bidirectional stop arm, bumper 170 preferably includes an upper machining head travel stop surface 179 that extends outwardly from and above the arm 171 such as in the manner shown in FIG. 4.

Where it is desired to further constrain movement or travel of the head 28 during use and operation of the machine 20, one of at least a plurality of different removable stops 180*a*, 180*b* or 180*c*, such as the removable stop 180*a* shown in FIGS. 1, 2 and 5-7, which is removably mountable to the machine 20 by releasably mounting the selected stop 180*a*, 180*b* or 180*c* to a ground of the machine 20 or to a grounded part of the machine 20. When mounted to machine 20, each one of the stops 180*a*, 180*b* and 180*c* operably cooperates with the machining head travel limiting stop arm 171 of the movable slide block 106*b* to limit an extent, distance or range of travel of the head 28, tool 80, and bit 82 during slug retention groove forming use and operation of the machine 20. Each one of the stops 180*a*, 180*b* or 180*c* limits the extent, distance or range of travel of the head 28, tool 80 and bit 82 in a different way with stop 180*a* limiting maximum downward machining head travel, stop 180*b* limiting the range of machining head travel to arrange less than the maximum range of travel without any stop 180*a*, 180*b* or 180*c* mounted to the machine 20, and stop 180*c* provides a manually adjustable return travel motion limiting arrangement that enables relatively precise adjustment of the range of machining head travel. Each one of the stops 180*a*, 180*b* and 180*c* is removably and preferably position-adjustably mountable to the machine 20 with the particular one of a plurality of the stops 180*a*, 180*b* or 180*c* selected by a user of the machine 20 to removably mount to the machine 20 being dependent on one or more factors, such as one or more of the following: (a) the thickness of the die cavity sidewall 27, (b) the depth of die cavity 25, (c) the length, width and/or depth of the groove 22 desired to be formed in sidewall 27, (d) the material from which the die 24 is made, (e) the thickness of the die 24, and/or (f) the amount by which the maximum distance or range of travel of the head 28, tool 80, and bit 82 is desired to be reduced or limited including in view of or with regards to any one or more of (a)-(e).

In a method of use of the machine 20 in accordance with the present invention, a plurality, preferably a plurality of pairs, i.e. at least three, of machining head motion limiting stops 180*a*, 180*b* and 180*c* are provided for use with the machine 20 with selection of a particular one of the stops 180*a*, 180*b* and 180*c* made by a user of the machine 20 being based on at least one and preferably a plurality of the following factors: (a) the thickness of the cavity sidewall 27, (b) the depth of die cavity 25, (c) the length, width and/or depth of the groove 22 desired to be formed in sidewall 27, (d) the material from which the die 24 is made, (e) the thickness of the die 24, and/or (f) the amount by which the maximum distance or range of travel of the head 28, tool 80, and bit 82 is desired to be reduced or limited including in view of or with regards to any one or more of (a)-(e). Such a method of use of the machine 20 further encompasses use and operation of the machine 20 by the user without any stop 180*a*, 180*b* or 180*c* being attached or used during machining of a groove 22 in a sidewall 27 of a cavity 25 of a die 24 being modified to prevent slug retention during stamping die use, e.g., during stamping press operation using the slug retention groove modified die 24.

In one such preferred method and embodiment of the machine 20, the machine 20 comes prepackaged, e.g. sold, with at least one, preferably at least a plurality, and more preferably, at least a plurality of pairs, i.e. at least three, of stops 180*a*, 180*b* and 180*c* that a user of the machine 20 can select, such as based on one or more of the aforementioned factors, and mount to the machine 20 in preparation for forming a groove 22 in a sidewall 27 of a cavity 25 of a die 24 being modified to prevent slug retention during die operation. In another such preferred method and machine 20, at least one, preferably a plurality, and more preferably, a plurality of pairs, i.e. at least three, of the stops 180*a*, 180*b* and/or 180*c* come prepackaged as a unit or kit available for purchase by a user of the machine 20 that is an owner or operator of the machine 20.

Each one of the stops 180*a*, 180*b* and 180*c* is configured to be removably mountable to ground of the machine 20 in substantially the same manner such that no matter which one of the plurality of stops 180*a*, 180*b* or 180*c* selected by user for use, the selected stop 180*a*, 180*b* or 180*c* is removably mounted to part of the machine 20, preferably to swivel plate 90, in substantially the same way as described in more detail below. In addition, each one of the stops 180*a*, 180*b* and 180*c* is configured in substantially the same manner to be adjustably mountable to the machine 20 in at least one of a plurality, preferably at least a plurality of pairs, i.e. at least three, of spaced apart vertical positions thereby enabling the position of the selected stop 180*a*, 180*b* or 180*c* mounted to the machine 20 to be adjusted relative to the cavity 25 of the die 24 desired to be slug retention groove modified.

With exemplary reference to a first stop 180*a* shown in FIGS. 1, 2 and 5-7, each one of the stops 180*a*, 180*b* and 180*c* has a stop mounting base 182 preferably formed of an elongate and generally rectangular plate 184 and employs a stop mounting assembly 186 that includes at least one and preferably a plurality of spaced apart stop mounts 188, 190 used to removably and position adjustably attach the stop 180*a* to part of the machine 20, preferably to an outboard edge or side 191 of the swivel plate 90. The mounting assembly 186 preferably is configured to fix the stop 180*a* to ground by enabling the stop 180*a* to be attached to a ground of the machine 20 that preferably is the swivel plate 90 when the swivel plate 90 is in a grounded condition by itself being fixed to ground in the manner discussed above. The mounting assembly 186 preferably also is configured for position-adjustable mounting the stop 180*a* to the machine 20, e.g. to swivel plate 90, in a manner that enables the position of the stop 180*a* relative to the die cavity 25 to be adjusted by a user of the machine 20 in a manner that correspondingly adjusts the extent or range of travel of the machining head 28, tool 80 and insert 82. When the desired position of a stop 180*a* that is position-adjustably mounted to machine 20 has been set by the user, the mounting assembly 186 preferably is further configured to substantially immovably fix the stop 180*a* to ground position-fixing the stop 180*a* to at least the swivel plate 90 preferably thereby also substantially immovably fixing the position of the stop 180*a* relative to the die cavity 25 in the desired position.

When the desired position of the stop 180*a* has been set and the user substantially immovably fixes the stop 180*a* to ground, the stop mounting assembly 186 preferably is configured to do so by substantially immovably fixing the stop 180*a* to the swivel plate 90 while the swivel plate 90 is disposed in the grounded condition. In a preferred stop mounting method and stop mounting assembly embodiment, mounting assembly 186 is configured to substantially immovably attach or mount the stop 180*a* to the swivel plate 90 with the mounting assembly 186 grounding the stop 180*a* when the swivel plate 90 is grounded by being fixed in the grounded condition in the manner discussed above. While the stop 180*a* is substantially immovably fixed to the swivel plate 90, a user of the machine 20 can still manipulate the swivel assembly 86 in the manner discussed above to angularly pivot the swivel plate 90 relative to machining head support 78 to adjust the angle of the head 28, tool 80 and insert 82 relative to vertical axis 79. During angular adjustment, clamping knob 98 is loosened taking the swivel plate 90 out of the grounded condition to enable angular adjustment and then tightened once the desired angle has been set to put the swivel plate 90 back into the grounded condition by grounding the swivel plate 90 the machining head support 78 as discussed above.

With continued reference to the first stop 180*a* shown in FIGS. 1, 2 and 5-7, stop mounts 188, 190 respectively include spaced apart stop mounting fasteners 192, 194 which extend through corresponding spaced apart stop mounting slots 196, 198 formed in stop mounting base plate 184 into engagement with outboard edge or side 191 of swivel plate 90 during both position-adjustable mounting of stop 180*a* to swivel plate 90 and position-fixing grounding of stop 180*a* to swivel plate 90. In a preferred embodiment, stop mount 188 includes one fastener 192 that extends through one elongate generally vertically extending slot 196 into engagement, preferably threaded engagement, with part of the outboard edge or side 191 of swivel plate 90, and stop mount 190 includes another fastener 194 that extends through another elongate generally vertically extending slot 198 into engagement, preferably threadable engagement, with another part of the outboard edge or side 191 of swivel plate 90 during both adjustable-position mounting and position-fixing grounding of the stop 180*a*.

With specific reference to FIGS. 3 and 4, the stop mounting assembly 186 preferably also includes at least a plurality, preferably at least a plurality of pairs of, i.e. at least three, bores 200*a*, 200*b*, 200*c*, 200*d*, 200*e* and 200*f* formed in the outboard edge or side 191 of the swivel plate 90 that are substantially equidistantly spaced apart along a machining head motion limiting stop mounting region 205 to which the stop 180*a* is position adjustably and removably mountable. Each one of the bores 200*a*, 200*b*, 200*c*, 200*d*, 200*e* and 200*f* is equidistantly spaced apart by about one quarter to one half inch enabling the stop 180*a* to be mounted to the outboard edge or side 191 of the swivel plate 90 anywhere along a one inch to one-and-a-half-inch adjustable stop mounting region 205 (FIG. 3) of the edge 187 where the bores 200*a*, 200*b*, 200*c*, 200*d*, 200*e* and 200*f* are located. In a preferred embodiment of mounting assembly 186, each one of the bores 200*a*, 200*b*, 200*c*, 200*d*, 200*e* and 200*f* preferably is internally threaded and each one of the stop mounting fasteners 192, 194 is externally threaded enabling threadable engagement there between when fasteners 192 and 194 are threadably received into corresponding threaded bores 200*a*, 200*b*, 200*c*, 200*d*, 200*e* and 200*f* in outboard edge or side 191 of swivel plate 90 during both position-adjustable mounting and position-fixing grounding of the stop 180*a* to swivel plate 90.

As best shown in FIG. 2, each one of the stop mounting fasteners 192 and 194 is formed of a thumbscrew 202 equipped with a manipulable head 204 from which an at least partially threaded elongate stem (not shown) outwardly extends and which includes or carries a radially outwardly extending clamping flange or washer 206 that bears against the stop mounting base plate 184 of the stop 180*a* during both position-adjustable mounting and position-fixing grounding urging the plate 184 against the outboard edge or side 191 of the swivel plate 90. For sake of convenience, only one of the fasteners 192, 194 has been labeled to show it is a thumbscrew 202 but both fasteners 192 and 194 of the stop mounting assembly 186 are thumbscrews 202. When position-adjustably mounted, each one of the fasteners 192 and 194 are manually tightened until the mounting base plate 184 of the stop 180*a* is urged against the outboard edge or side 191 of the swivel plate 90 with enough force to frictionally retain the position of the plate 184 in place but allow the user to slidably move the plate 184, and hence stop 180*a*, relative to the swivel plate 90 until a desired position of the stop 180*a* has been set.

Once the desired position of the stop 180*a* has been set, the stop mounting fasteners 192, 194 are manually tightened even more until the stop mounting base plate 184 is substantially immovably clamped by the fasteners 192, 194 against the outboard side 191 of the swivel plate 90 with enough force to substantially immovably fix the stop 180*a* in place grounding the stop 180*a* to at least the swivel plate 90. When the swivel plate 90 is position-fixed to ground by tightening the clamping knob until the swivel plate 90 is put in the grounded condition, the stop 180*a* is not only position-fixed grounded to the swivel plate 90 but position-fixed to the ground of the machine 20.

Figure 5:
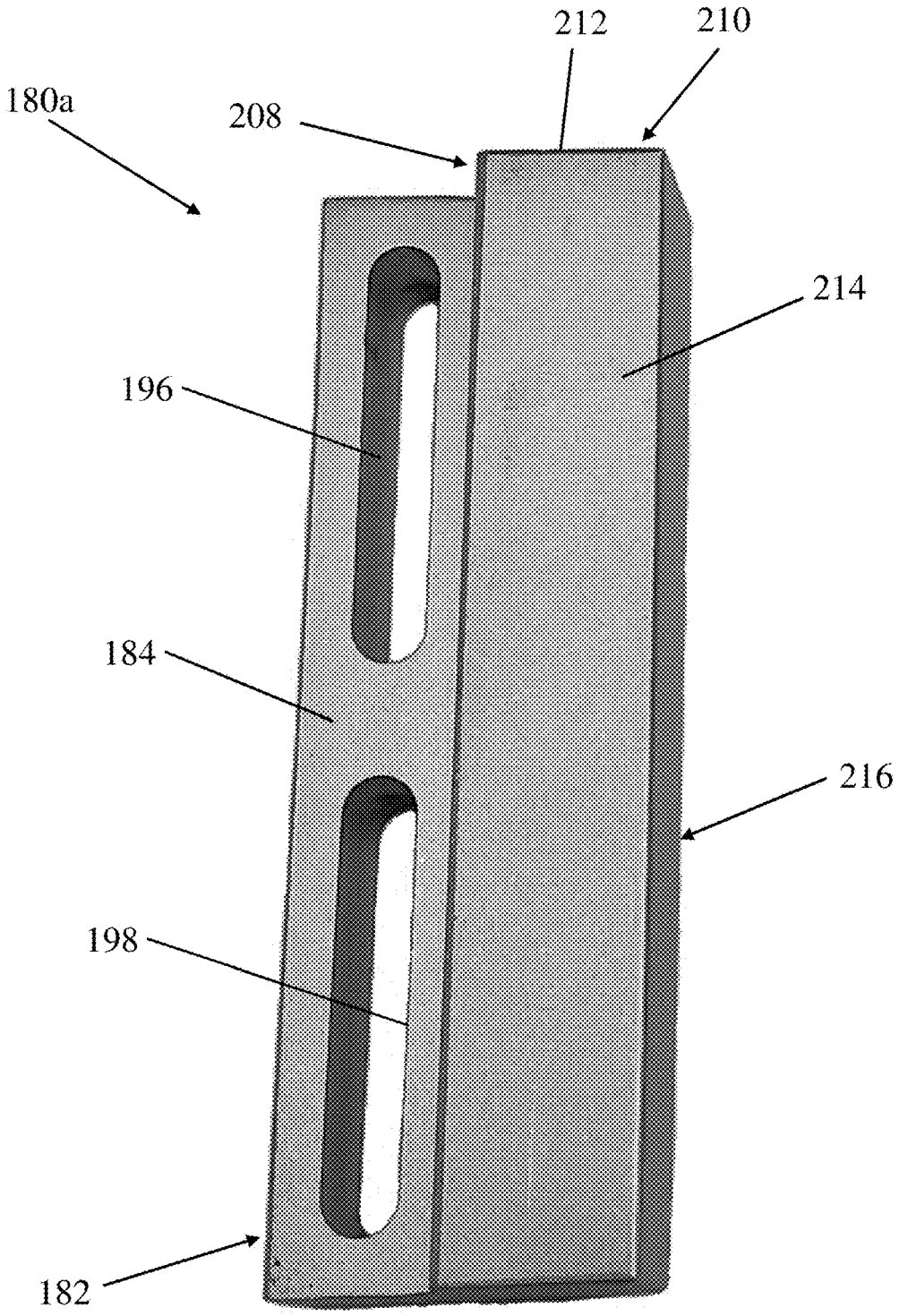
FIG. 5 is an enlarged rear bottom perspective view of the first stop.

With continued reference to FIGS. 1, 2, and 5-7, stop 180*a* is a downward machining head travel motion limiting stop 180*a* that operably cooperates with the machining head travel limiting stop arm 171 to limit the extent, range or distance of downward travel of the machining head 28, tool 80 and insert 82 to less than the aforementioned maximum range or extent of machining head travel available when there is no stop 180*a*, 180*b* and 180*c* mounted to the machine 20. As is shown in FIGS. 2 and 5, stop 180*a* has a machining head motion limiting abutment arm 208 that extends from the stop mounting base plate 184 that operably cooperates with the stop arm 171 to limit downward travel of the head 28, tool 80 and bit 82 toward and/or into the die cavity 25 when stop 180*a* is mounted to the machine 20 by preferably being position-fixed to ground. In a preferred embodiment and method of use, the motion limiting abutment arm 208 of position-fixed grounded stop 180*a* interferes with additional downward travel of the head 28, tool 80 and bit 82 when the stop arm 171 comes into contact therewith to limit the extent or distance of downward machining head travel to an extent or distance less than the maximum when no stop 180*a*, 180*b*, or 180*c* is mounted to the machine 20.

The machining head motion limiting abutment arm 208 of stop 180*a* includes a machining head stop abutment 210 formed at least in part by a generally flat or planar outer or upper surface 212 of the arm 208 disposed at the upper or top end of the stop 180*a* against which at least part of the travel limiting stop arm 171 of the movable slide block 106*b* abuts to stop any farther downward movement or travel of the machining head 28 toward die cavity 25 during slug retention groove forming use and operation of the machine 20. The arm 208 projects outwardly from the mounting base plate 184, e.g., base 182, of stop 180*a* and underlies the stop arm 171 when the stop 180*a* is mounted to the machine 20, preferably position-fixed grounded thereto, by being mounted to swivel plate 90.

The machining head travel limiting abutment arm 208 extends outwardly from the mounting base plate 184, e.g., base 182, of stop 180*a* at an oblique angle relative thereto positioning the arm 208 between the machining head travel limiting stop arm 171 of the movable slide block 106*b* and the grounded machining head travel limiting stop landing 163 provided by part of the top 155 of the fixed slide block 106*a*. In a preferred embodiment, the arm 208 extends generally transversely outwardly from the base plate 184 of stop 180*a* generally at a right angle thereto such that the arm 208 is generally perpendicular to the base plate 184.

While the machining head travel limiting abutment arm 208 can be a fingerlike projection that extends outwardly from the base 182, e.g., extends outwardly from stop mounting base plate 184, the abutment arm 208 preferably is formed of or by a flange 214 that can be and preferably is elongate such as is depicted in FIG. 5. Stop 180*a* can also include an outer bevel 185 disposed at a junction between the stop mounting base plate 184, e.g., base 182, and the flange 214 as shown in FIG. 2. With continued reference to FIG. 5, flange 214 preferably is substantially straight and can and preferably does extend substantially the full length of base 182 such that flange 214 defines a generally L-shaped stop 180*a* and preferably also provides a stop mount support 216 (FIG. 5) that can be braced against part of the machine 20, such as part of the slide arrangement 104, during mounting of the stop 180*a* to the machine 20 to help facilitate ease of attachment of stop 180*a* to the machine 20. Flange 214 can and preferably does also help strengthen and/or structurally rigidify the stop 180*a* and can also help guide machining head travel during movement of the head 28, tool 80 and bit 82 toward and away from the die cavity 25, including during machining of groove 22. Stop surface 212 of stop abutment 210 of machining head travel limiting abutment arm 208 is disposed at a top or upper end of the flange 214 as also shown in FIG. 5.

In a preferred method of use of downward motion limiting stop 180*a*, stop 180*a* is mounted to the machine 20 by first position-adjustably mounting the stop 180*a* to the outboard side 191 of the swivel plate 90. When the stop 180*a* is mounted to the machine 20, the mounting base plate 184 and flange 214 preferably are configured to wrap around a side and the front of the carriage 74 of the machine 20 as shown in FIG. 2. The stop 180*a* is position-adjustably mounted to the machine 20 positioning the machining head travel limiting abutment arm 208 between the stop arm 171 of the movable slide block 106*b* and the grounded machining head travel limiting stop landing 163 provided by part of the top 155 of the fixed slide block 106*a*. The position of the stop 180*a* is adjusted relative to the stop arm 171, which is disposed at the top of its range of travel, and the die cavity 25 desired to be slug retention groove modified based on one or more of the stop position-setting adjustment factors (a)-(f) set forth above. In a preferred method of use of stop 180*a*, the position of stop 180*a* is adjustably set relative to the travel limiting stop arm 171 and die cavity 25 desired to be slug retention groove modified based on at least a plurality of the stop position-setting adjustment factors (a)-(f) set forth above.

After position adjustment is completed, the stop 180*a* is position-fixed to the swivel plate 90 preferably thereby position-fixing the stop 180*a* to ground preventing the position of the stop 180*a* from changing during machining of groove 22 in sidewall 27 of cavity 25 during machine operation. During slug retention groove forming machine operation, the machining head 28 is manually urged downwardly by user toward die cavity 25 displacing the head 28, tool 80 and bit 82 downwardly toward cavity 25. Movement or displacement of the head 28, tool 80 and bit 82 toward and into die cavity 25 continues until the travel limiting stop arm 171 makes contact with the machining head travel limiting abutment arm 208 of stop 180*a*, which thereby prevents the head 28, tool 80 and bit 82 from traveling any farther towards the die cavity 25. The lower machining head travel stop surface 172 of the elastomeric bumper 170 carried by the stop arm 171 preferably first makes contact with part of the top surface 212 of the machining head stop abutment 210 of the travel limiting abutment arm 208 of stop 180*a* thereby helping reduce the magnitude of the stopping force due to deceleration of the stop arm 171 abutting against the arm 208 during stopping of head 28, tool 80 and bit 82.

When further travel of machining head 28, tool 80 and bit 82 is stopped by such abutting contact between arms 171 and 208, at least a portion of elastomeric bumper 170 is sandwiched therebetween preventing direct contact between arms 171 and 208 helping to isolate and dampen vibrations in the head 28, tool 80 and/or bit 82 produced by contact of the rotating bit 82 with the cavity sidewall 27 during machining of groove 22. The vibration isolation and/or vibration damping provided by the bumper 170, including the portion of the bumper 170 sandwiched between the arms 171 and 208 when machining head travel is stopped help prevent the bit 82 from "walking" along the sidewall 27 while machining the groove 22. Such vibration isolation and vibration damping helps to not only prevent the bit 82 from "walking" but also prevents "chatter" during slug retention groove machining, which advantageously allows an operator to hear the grinding bit 82 touch the die cavity sidewall 27 while preventing the operator from hearing the machining head 28 when it touches the machining head travel stops 127. In short, by preventing "chatter" during slug retention groove machining and minimizing noise produce when the machining head 28 contacts the machining head travel stops 127, an operator is now able to actually hear the grinding bit 82 touch the cavity sidewall 27 during groove machining thereby providing acoustic feedback to the operator that enables the operator to determine when groove machining is completed. Generation of such acoustic feedback during slug retention groove machining that is audible to the operator during groove machining can and preferably does help the operator know not only when groove machining is started and completed but which also helps the operator guide the grinding bit 82 up and down in a controlled fashion to help produce a slug retention groove 22 with a more consistent groove depth. This advantageously helps form a more uniform slug retention groove 22 in the sidewall 27 that better prevents slug retention from occurring for a longer period of time during die operation thereby also potentially helping to extend the useful life of die cavities 25 with slug retention grooves 22 formed by a slug retention groove forming machine 20 of the present invention.

During such stop limited, vibration-dampened machining head travel, the machining bit 82 of the tool 80 forms groove 22 in the sidewall 27 of die cavity 25. Use of vibration-isolating and/or vibration-dampened stop 180*a* advantageously makes machining of the groove 22 in the sidewall 27 faster and easier (a) by the stop 180*a* reducing the distance or extent of downward travel of the head 28, tool 80 and bit 82 toward the die cavity 25 to a machining head travel distance that is less than the maximum machining head travel distance of the machine 20 toward cavity 25 when no stop 180*a*, 180*b* or 180*c* is used, and (b) by the vibration isolation and/or dampening provided during slug retention groove machining by elastomeric bumper 170. Use of such a stop 180*a* to limit the extent or distance of machining head travel also advantageously enables a slug retention groove forming machine 20 constructed in accordance with the present invention and operated in accordance with such a vibration reducing machining head travel limiting method of the present invention to be used with dies having thinner cross-sectional thicknesses, die cavities with thinner sidewall thicknesses, and dies made of material that made it more difficult, if not virtually impossible, in the past to form a slug retention grooves therein.

FIGS. 8-9 illustrate a preferred embodiment of a second stop 180*b* that preferably is a machining head travel range limiting stop 180*b* having a machining head travel range limiting stop arm travel range-defining recess 222 (FIG. 8) defined by spaced apart upper and lower machining head travel range-defining abutment arms 224, 226 (FIG. 8) between which the machining head travel limiting stop arm 171 of the movable slide block 106*b* is received and can travel when the stop 180*b* is fixed to the machine 20. When the stop 180*b* is mounted to the machine 20, such as in the manner depicted in FIG. 9, the machining head motion limiting stop arm 171 is disposed in the fixed machining head travel range-defining recess 222 such that the upper machining head travel range boundary defining abutment arm 224 limits an upper extent or distance of return travel of the head 28, tool 80 and bit 82 to an extent or distance less than the maximum return travel extent or distance of the head 28, tool 80 and bit 82 when no stop 180*a*, 180*b* or 180*c* whatsoever is mounted to the machine 20. When the stop 180*b* is mounted to the machine 20, e.g., in the manner depicted in FIG. 9, and is disposed in the recess 222, the lower machining head travel range boundary defining abutment arm 226 limits a lower extent or distance of downward travel of the head 28, tool 80 and bit 82 toward and/or into die cavity 25 to an extent or distance less than the maximum downward travel extent or distance of the head 28, tool 80 and bit 82 when no stop 180*a*, 180*b* or 180*c* whatsoever is mounted to the machine 20. As discussed in more detail below, the machining head travel range provided by stop 180*b* is fixed in that recess 222 is fixed in size or length by the fixed non-adjustable or non-changeable distance between the upper and lower abutment arms 224 and 226, which are also fixed, and is substantially immovable relative to die cavity 25 when the stop 180*b* is position-fixed, e.g., grounded, to the machine 20 in preparation for and during slug retention groove machining.

With reference once again to FIG. 8, the machining head travel range limiting stop 180*b* also is formed of such a stop mounting base 180, which in turn is formed of such a generally rectangular stop mounting base plate 184 in which elongate generally longitudinally extending and generally longitudinally aligned mounting through-slots 196 and 198 are formed. Stop 180*b* preferably also has an elongate longitudinally extending flange 214' extending generally outwardly therefrom like stop 180*a* but which has generally transversely extending cradle-defining channel 228 formed therein dividing the flange 214' into two generally longitudinally spaced apart flange sections 230 and 232 from which the upper and lower machining head travel range boundary defining abutment arms 224, 226 are formed that define the machining head travel limiting stop arm travel range-defining recess 222 in which travel limiting stop arm 171 can travel during machine operation and in which the stop arm 171 is received.

The upper and lower machining head travel range boundary defining abutment arms 224 and 226 spaced apart and disposed in opposition with one another with the upper abutment arm 224 having a first or upper generally flat or planar machining head travel limiting stop arm stop surface 234 facing generally downwardly toward and opposing a second or lower generally flat or planar machining head travel limiting stop arm stop surface 236. As is shown in FIG. 8, the second or lower generally flat or planar machining head travel limiting stop arm stop surface 236 faces generally upwardly toward and opposes the first or upper machining head travel limiting stop arm stop surface 234. When the machining head travel range limiting stop 180*b* is mounted to the machine 20 in the manner generally depicted in FIG. 9, the machining head travel limiting stop arm 171 stops or abuts against the upper stop surface 234, thereby limiting the maximum upper or return travel distance to a distance less than the maximum upper or return travel distance when no stop 180*a*, 180*b* or 180*c* whatsoever is mounted to the machine 20. When the machining head travel range limiting stop 180*b* is mounted to the machine 20 in the manner generally depicted in FIG. 9, the stop arm 171 stops or abuts against the lower stop surface 236, thereby limiting the maximum downward travel distance toward and/or into die cavity 25 to a distance less than the maximum downward travel distance toward and/or into cavity 25 when no stop 180*a*, 180*b* or 180*c* whatsoever is mounted to the machine 20.

When the machining head travel range limiting stop 180*b* is installed, the distance of the upper range of travel, e.g. return travel, of the head 28, tool 80 and bit 82 can be and preferably is reduced from the maximum distance of the upper range of travel, e.g., return travel, of the head 28, tool 80 and bit 82 without any stop 180*a*, 180*b* and 180*c* installed to a lesser distance that is the distance of the stop arm receiving recess 222 between the abutment arms 224 and 226. When the machining head travel range limiting stop 180*b* is installed, the distance of the lower range of travel, e.g. downward travel, of the head 28, tool 80 and bit 82 is reduced from the maximum distance of the lower range of travel, e.g., downward travel, of the head 28, tool 80 and bit 82 without any stop 180*a*, 180*b* and 180*c* installed.

During at least setup as well as during use of the machine 20 when the machining head travel range limiting stop 180*b* is installed, the machining head 28 preferably is automatically biased, e.g., by machining head return travel biasing element 160, e.g., spring 161, in the manner discussed above to return the head 28, tool 80 and bit 82 to a default return travel position where at least part of the machining head travel limiting stop arm 171 stops or abuts against at least part of the upper stop surface 234 of the upper abutment arm 224 preventing any farther return travel of the head 28, tool 80 and bit 82. In a preferred embodiment, the upper machining head travel stop surface 179 of the bumper 170 carried by the stop arm 171 in the manner depicted in FIG. 9 makes first contact with the upper abutment arm 224 when the travel limiting stop arm 171 is stopped by the upper abutment arm 224 thereby advantageously reducing the magnitude of deceleration of stop arm 171 (and head 28, tool 80 and bit 82) as stop arm 171 comes to a complete stop. When movement of the stop arm 171 is stopped by the upper abutment arm 224, a portion of the bumper 170, including its upper stop surface 179, preferably extends outwardly and upwardly above the stop arm 171 such that there preferably is at least a portion of the bumper 170 disposed between the arms 171 and 224 preferably defining and/or providing a cushioned upper travel stop and preferably also preventing direct contact between the arms 171 and 224.

During slug retention groove forming operation of the machine 20 when stop 180*b* is installed and the machining head 28 urged generally downwardly toward and/or into the die cavity 25, the head 28, tool 80 and bit 82 travel generally downwardly toward and/or into the cavity 25 until at least part of the machining head travel limiting stop arm 171 stops or abuts against at least part of the lower stop surface 236 of the lower abutment arm 226 preventing any farther downward travel of the head 28, tool 80 and bit 82 toward and/or into the cavity 25. In a preferred embodiment, the lower machining head travel stop surface 172 of the bumper 170 carried by the stop arm 171 in the manner depicted in FIG. 9 makes first contact with the lower abutment arm 226 when the stop arm 171 is stopped by the lower abutment arm 226 thereby advantageously reducing magnitude of deceleration of stop arm 171 (and head 28, tool 80 and bit 82) as stop arm 171 comes to a stop. When movement of the stop arm 171 is stopped by the lower abutment arm 226, a portion of the bumper 170, including its lower stop surface 172, preferably extends outwardly and downwardly from the stop arm 171 such that there preferably is at least a portion of the bumper 170 disposed between the arms 171 and 226 preferably defining and/or providing a cushioned lower travel stop and preferably also preventing direct contact between the arms 171 and 224. In addition to the bumper 170 defining and/or providing such a cushioned lower travel stop, at least the portion of the bumper 170, including its lower stop surface 172, which extends outwardly and downwardly below the stop arm 171, also isolates, cushions and dampens vibration of the bit 82 and tool 80 during rotary contact by the bit 82 with the sidewall 27 of the die cavity 25 in which a slug retention groove 22 is being machined.

In a preferred embodiment of the machining head travel range limiting stop 180*b*, the distance of the stop arm receiving or fixed travel range-defining recess 222 defined by the space between abutment arms 224 and 226 along which the stop arm 171 can travel when stop 180*b* is installed preferably is no more than one inch, preferably no more than about ½ inch, and more preferably no more than about ¼ inch. In one preferred embodiment, stop 180*b* has a stop arm travel range-defining recess 222 that defines a fixed stop arm travel distance or range of no more than about ½ inch between the abutment arms 224 and 226. In another preferred embodiment, stop 180*b* has a fixed stop arm travel range-defining recess 222 that defines a fixed stop arm travel distance or range of no more than about ¼ of an inch between the abutment arms 224 and 226. As a result, the total travel distance or range of the stop arm 171 and its damper arrangement 168 being significantly reduced when stop 180*b* is used, stop 180*b* can be referred to as a "speed stop" because it advantageously enables each slug retention groove 22 to be machined more quickly into die cavity sidewall 27 when stop 180*b* is used. Where the machine 20 has a machining head travel range or distance of at least one inch when no stop 180*a*, 180*b* or 180*c* is used, use of such a "speed" stop 180*b* reduces slug retention groove machining time by at least 25%, and in many instances, reduces slug retention groove machining time by at least 40% as compared to when no stop 180*a*, 180*b* or 180*c* is mounted to the machine 20.

When installing the stop 180*b*, a user can adjust a starting or return height of the stop arm 171 and damper arrangement 168, e.g., bumper 170, so that the slug retention groove machining insert 82 is disposed at a desired pre-groove machining starting height relative to the die cavity 25 as well as its sidewall 27 with the stop 180*b* position-adjustably mounted to the machine 20. When a desired height of the stop arm 171 and damper arrangement 168 is achieved, user slidably moves the stop 180*b* up or down until the upper machining head travel range defining abutment arm 224 is adjacent to or in contact with the stop arm 171 and/or damper arrangement 168, e.g., bumper 170. Once a desired position of the upper abutment arm 224 of the position-adjustably mounted stop 180*b* is set relative to the height-adjusted stop arm 171 and damper arrangement 168 disposed at their desired height, the stop 180*b* is position-fixed to the machine 20 preferably by tightening both stop mounting fasteners 192 and 194 until the stop 180*b* is substantially immovably fixed in place, e.g. fixed to ground. When the stop 180*b* is position-fixed to the machine 20, the upper abutment arm 224 presets the maximum height or distance of return travel of the stop arm 171, damping arrangement 168, e.g., bumper 170, head 28, tool 80, and insert 82 before any machining of a groove 22 into the sidewall 27 of die cavity 25 begins.

When the machining head 28 is released, the head 28, movable slide block 106*b*, stop arm 171 and damper arrangement 168, e.g., bumper 170, are urged upwardly by machining head return biasing element 160, preferably by spring 161, until the damper arrangement 168 and/or stop arm 171 stop against the upper abutment arm 224 of stop 180*b* preferably ensuring that the groove machining bit 82 will clear the opening of the die cavity 25 in preparation for slug retention groove machining. The machine 20 can thereafter be moved around about the die opening 25 to make one or more slug retention grooves 22 in an efficient manner without adjusting or otherwise changing the position of the stop 180*b* on the machine 20. In machining each groove 22, the head 28 is pressed downwardly by the user, such as by the user manually urging part of the head 28, e.g., part of the stop arm 171, downwardly displacing the tool 80 and bit 82 toward and into the die opening 25. As the rotating bit 82 comes in contact with the die cavity sidewall 27 upon entering the die opening 25, the bit 82 forms an elongate, substantially straight, and generally downwardly extending groove 22 in the sidewall 27 that preferably is inclined at an acute included angle relative to an axis of a reciprocating die (not shown) entering the opening 25 during stamping press operation. The head 28 preferably is manually urged farther downwardly by the user toward the die opening 25 while the rotating bit 82 is machining a groove 22 in cavity sidewall 27 until the stop arm 171 and/or damper arrangement 168 comes into contact with the lower abutment arm 226 stopping any farther downward travel of the head 28, tool 80 and bit 82. Upon the damper arrangement 168 of the stop arm 171 making contact with the lower abutment arm 226, releasing of the head 28 causes the biasing element 160, e.g., spring 161, to automatically urge the head 28 upwardly until the damper arrangement 168 and/or stop arm 171 makes contact with the upper abutment arm 224 returning the head 28 back to the original height or distance from which the slug retention groove machining process was originally started.

Such a machining head travel range method of operation of a slug retention groove forming machine 20 of the present invention equipped with such a "speed" machining head travel range limiting stop 180*b* of the present invention can advantageously be relatively rapidly repeated over and over again to machine one or more and preferably at least a plurality of slug retention grooves 22 in at least one, and preferably a plurality of die cavities 25 of a single stamping die 24 thereby increasing the slug retention groove machining production of such a slug retention groove forming machine 20 of the present invention. Because the height or distance of the upper abutment arm 224 is adjusted and set to position the groove cutting bit 82 adjacent and preferably within a few millimeters of the die cavity 25 and cavity sidewall 27, a user of the machine 20 only needs to move the head 28 downwardly a few millimeters in many instances and typically no more than ¼ inch to one half inch in most instances toward and into the cavity 25 to very quickly machine a groove 22 into the sidewall 27 of the cavity 25. As a result, use of such a "speed" machining head travel range limiting stop 180*b* with a preferred embodiment of a slug retention groove forming machine 20 constructed in accordance with the present invention advantageously makes pre-slug retention groove machining setup easier and quicker and also advantageously dramatically speeds slug retention groove machining.

FIGS. 10-12 illustrate a preferred embodiment of a third stop 180*c* that preferably is an adjustable machining head travel range limiting stop 180*c* that is similar in construction to the "speed" machining head travel range limiting stop 180*b* of FIGS. 8-9, but which additionally includes a manipulable upper or return machining head travel range-limiting adjuster 240 that is manually adjustable by user to increase or decrease the maximum machining head travel range provided by the fixed stop machining head travel limiting stop arm travel range-defining recess 222 defined by the distance between the fixed upper and lower abutment arms 224 and 226 of stop 180*b*. While the aforementioned "speed" stop 180*b* works well and actually is optimal for use in many slug retention groove machining applications, particularly for thicker stamping dies, improvements nonetheless remain desirable. Because the machining head travel range provided by the fixed stop arm travel range-defining recess 222 of the aforementioned "speed" stop 180*b* is fixed since the distance between the upper and lower abutment arms 224 and 226 of stop 180*b* also is fixed, (a) reducing the machining head travel range from the fixed range is not possible, and (b) reducing the pre-slug retention groove starting height after the stop 180*b* is position-fixed, e.g. grounded, to the machine 20 also is not possible. The adjustable machining head travel range limiting stop 180*c* improves upon the fixed range "speed" stop 180*b* by substantially adopting the construction of stop 180*b* but adding an upper or return machining head travel range-limiting adjuster 240 not only enables the machining head travel range to be adjustably reduced, but which also advantageously enables adjustment of the pre-slug retention groove starting height while the mounting base 182 of the stop 180*c* is immovably position-fixed, e.g., grounded, to the machine 20. Finally, it is contemplated that the adjuster 240 of such an adjustable machining head travel range limiting stop 180*c* of the present invention can be and preferably also is a vertically displacing machining head drive 264 that a user can manipulate to very slowly and relatively precisely displace the machining head 28, tool 80 and bit 82 from the pre-slug retention groove starting height downwardly toward and into the die cavity or opening 25 during slug retention groove machining helping to enable grooves 22 to be formed more accurately, more quickly, and in die cavities with thinner sidewalls than what was previously believed possible.

The machining head upper travel range-limiting adjuster 240 is disposed on top of adjustable stop 108*c* and is configured to not only provide adjustment of the machining head travel range, but which also provides adjustment of pre-slug retention groove starting height adjustment helping to not only form more uniform and precise slug retention grooves 22 but which also advantageously help enable the machine 20 to be used to form slug retention grooves 22 in die cavities or openings 25 with the smallest die opening that can be machined being an opening as thin as 0.028 inches (0.7 mm). Without this stop 108*c* equipped with an adjuster 240, the smallest die opening 25 that could be machined would be a slot opening as thin as 0.04 inches (1.0 mm). As is best shown in FIG. 10, the adjuster 240 employs a movable machining head travel range-limiting stop end 242 disposed at a free end of an adjustably extensible position-adjustable guide stop post 244 carried by the stop 180*c* that is longitudinally axially displaceable relative thereto and which preferably is formed of an elongate threaded machining head travel range-defining fastener 246, more preferably in the form of an elongate rotatable threaded thumb screw 248, which is threadably received in a longitudinally extending threaded through-bore 250 formed in the fixed upper abutment arm 224. The movable machining head travel range-limiting stop end 242 of the extensible stop post 244, preferably thumbscrew 248, provides a movable selectively extensible and/or retractable position-adjustable upper or travel range limiting abutment arm 245 that extends from the fixed upper abutment arm 224 into the stop arm travel range-defining recess 222 and which is user adjustable relative to the fixed upper and lower abutment arms 224 and 226 to pre-set to position the bit 82 at a desired pre-slug retention groove machining starting height in preparation for slug retention groove machining.

Where a thumbscrew 248 is used to provide or facilitate machining head travel range and/or pre-slug retention groove starting height adjustment, thumbscrew 248 preferably has a manually graspable head 252 from which a generally cylindrical externally threaded stem 254 outwardly extends. With continued reference to FIG. 10, the threaded stem 254 of the thumbscrew 248 is threadably received in a threaded bore 250 in fixed upper abutment arm 224 with the free or axial end of the stem 254 forming movable machining head travel range-limiting stop end 242 that defines upper position-adjustable abutment arm 245. As is best shown in FIG. 10, at least a portion of the axial or free end of the threaded stem 254 of the thumbscrew 248 extends beyond the fixed upper abutment arm 224 into the stop arm travel range-defining recess 222 thereby disposing the position-adjustable machining head travel range-limiting stop end 242 and thereby the position-adjustable upper abutment arm 245 in the recess 222 reducing the maximum machining head travel range to less than that provided by the recess 222 as defined by the distance between fixed abutment arms 224 and 226.

The adjuster 240, and more specifically the position-adjustable extensible stop post 244 of the adjuster 240, preferably also includes an upper machining head travel range-limit or retention groove machining bit starting height lock 256 carried thereby that is manipulable, e.g. manually adjustable, between (a) an unlocked position that allows user adjustment of the machining head travel range and pre-slug retention groove starting height between one of at least a plurality, preferably at least a plurality of pairs, i.e. at least three, of ranges and heights, each range of which preferably is less than the machining head travel range defined by the distance between upper and lower abutment arms 224 and 226, and (b) a locked position that prevents the desired machining head travel range and pre-slug retention groove starting height set by the user using adjuster 240 from being changed during slug retention groove machine setup, e.g., pre-slug retention groove starting height setup, use and operation of the machine 20. With continued reference to FIG. 10, a preferred machining head travel range limit or machining bit height lock 256 includes a machining head travel range adjustment and pre-slug retention groove machining bit starting height setting locking nut 258 threadably carried by the threaded stem 254 of thumbscrew 248 that is disposed between the manually graspable head 252 of the thumbscrew 248 and the upper abutment arm 224. The machining head travel range limit or machining bit starting position lock 256 can and preferably does include at least one lock washer 260 carried by the thumbscrew threaded stem 254 that is disposed between the machining head travel range adjustment and/or machining bit starting height setting locking nut 258 and upper abutment arm 224 that prevents the locking nut 258 from loosening once the desired machining head travel range and pre-slug retention groove starting height has been set and locked. If desired, another washer 262, such as another lock washer, can also be carried by the threaded stem 254 of thumbscrew 248 that is disposed between the thumbscrew head 252 and the locking nut 258, such as in the manner further depicted in FIG. 10.

With reference to FIGS. 10-12, when the adjustable stop 180*c* is mounted to the machine 20, the machining head travel limiting stop arm 171 is received in the stop arm travel range-defining recess 222 and disposed between the fixed upper and lower abutment arms 224 and 226 with the adjuster 240 disposed on top of stop 180*c* preferably overlying the stop arm 171 ready to be used to selectively limit the range of machining head travel and/or set pre-slug retention groove starting height. Such an adjustable stop 180*c* constructed in accordance with the present invention enables the distance or range of travel of the head 28, tool 80 and bit 82 to be adjustably preset before slug retention groove machining to be not only less than the maximum range of machining head travel without any stop 180*a*, 180*b* and 180*c* installed but also to be less than the reduced range of machining head travel provided when the fixed machining head travel range limiting stop 180*b* that lacks any such adjuster 240 is installed.

Adjustable stop 180*c* preferably is used where it is desired to adjust, e.g. limit, the distance or range of travel that the groove machining bit 82 (and head 28 and tool 80) is allowed to move toward and into the die cavity 25 during machining of a slug retention groove 22 in the sidewall 27 of the cavity 25. The adjustable stop 180*c* also is preferably used where the slot opening that is machined is thinner than 0.04 inches (1.0 mm), and more preferably thinner than 0.035 inches (0.89 mm), and more preferably approximately thinner enabling the distance or range of travel of the bit 82 to be correspondingly reduced or limited in relation to the thickness of the sidewall 27 to advantageously enable a groove 22 to be machined therein. The adjustable stop 180*c* preferably is also used where it is desired to preset a pre-slug retention groove starting height relatively close to the opening of the die cavity 25 by presetting the height of the adjustably movable upper abutment arm 245 against which the travel limiting stop arm 171 and/or damper arrangement 168, e.g. bumper 170, are upwardly urged by the machining head return biasing element 160, e.g., spring 161, also advantageously helping to machine slug retention grooves 22 in die cavities 25 with such thinner sidewalls 27.

When the adjuster 240 is manipulated by the user to extend and reposition the machining head upper travel limiting stop end 242, and hence the adjustably displaceable upper abutment arm 245, of the adjustably extensible stop post 244 into the recess 222 and toward stop arm 171, doing so reduces an actual range of machining head travel to a range of travel less than the maximum range of machining head travel of the stop 180*c* with the stop post 244 fully retracted or even completely removed from stop 180*c*. Doing so also reduces the pre-groove machining starting height of the bit 82 relative to the opening of the die cavity 25 by moving the location of the adjustably extendable upper abutment arm 245 closer thereto which thereby also moves the return travel location of the stop arm 171, head 28, tool 80 and bit 82 to correspond thereto.

Where adjuster 240 utilizes an adjustably movable stop post 244 that is a thumbscrew 248, the head 252 of the thumbscrew 248 is manually grasped to rotate the thumbscrew 248 (*a*) in one direction to extend the stop end 242 and the position-adjustable upper abutment arm 245 farther into the recess 222 to further limit the range of machining head and machining bit travel during slug retention groove forming operation, and (b) in an opposite direction to retract the stop end 242 and selectively-positionable upper abutment arm 245 away from the lower abutment arm 226 to thereby increase the range of machining head and machining bit travel during slug retention groove forming operation. Depending on the direction of thumbscrew rotation, the amount of the range of machining head and machining bit travel as well as the pre-groove machining starting height of the bit 82 can advantageously both be relatively precisely set by a user of the machine 20 in preparation for machining one or more grooves 22 depending on one or more of (a)-(h) set forth above, and preferably depending on at least a plurality of (a)-(h) above.

The threaded stem 254 of the thumbscrew 248 generally overlies and preferably is generally coaxial with the damper arrangement 168, e.g. bumper 170, such the upper machining head travel stop surface 179 of the damper arrangement 168 preferably makes initial contact with the abutment arm 245 at the stop end 242 of the thumbscrew 248 with the damper arrangement 168 during machine use, including return machining head travel, with the top surface 179 and adjacent portion of damper arrangement 168 extending upwardly of or from machining head travel limiting stop arm 171 thereby providing a soft acceleration absorbing and vibration dampening stop between the stop arm 171 and the upper abutment arm 245. The thumbscrew 248 of the adjuster 240 can be rotated by the user as needed to relatively precisely set a reduced machining head and cutting bit range of travel small enough to enable the machine 20 to be used to machine grooves 22 in dies 24 with where a slot opening that is machined is thinner than 0.04 inches (1.0 mm), and more preferably thinner than 0.035 inches (0.89 mm), and more preferably approximately thinner enabling a slug retention groove forming machine 20 of the present invention to advantageously be able to machine grooves 22 in thinner stamping dies than ever before.

In a preferred embodiment, the adjustably extensible stop post 244, and more specifically the thumbscrew 248, can and preferably does provide a slow or precision movement machining head drive 264 (FIG. 10) when displaced, preferably via rotation, in a direction that causes the position-adjustable upper abutment arm 245 of the stop end 242 to bear against the damper arrangement 168, e.g. bumper 170, displacing damper arrangement 168 stop arm 171, head 28, tool 80 and bit 82 substantially in unison such that stop end or adjustable upper abutment arm displacement thereby slowly and precisely moves the head 28, tool 80 and bit 82 toward the die cavity 25 and into slug retention groove machining contact with the sidewall 27 of cavity 25 during machining of groove 22. Where the adjuster 240, preferably adjustably movable stop post 244, more preferably thumbscrew 248, is used as such a machining head drive 264, the thumbscrew 248 is displaced, preferably via manual thumbscrew rotation, in one direction to cause the adjustable abutment arm to move toward the upper abutment arm 245 of the stop end 242 to displace the damper arrangement 168 and stop arm 171 of the movable slide block **106*b* to move the head 28, tool 80 and bit 82 downwardly toward the die cavity 25 into engagement with the sidewall 27 to machine groove 22 in the sidewall 27. When machining of the groove 22 is finished, the adjuster 240, preferably position-adjustable stop post 244, more preferably thumbscrew 248, can be manually displaced, preferably via thumbscrew rotation in the opposite direction by the user to retract the movable upper abutment arm 245 of the stop end 242 to thereby retract the head 28, tool 80 and bit 82 out of the die cavity 25 and then upwardly away from the cavity 25 leaving the cavity sidewall 27 with a completed groove 22** formed therein.

In the preferred embodiment of the slug retention groove forming machine 20 shown in the drawings, the tool 80 used to machine slug retention grooves 22 is a grinder 125, such as a fluid powered grinder, which preferably is an air or pneumatic grinder, more preferably a pneumatic pencil grinder or micro-air grinder, powered by a supply of pressurized air, e.g. compressed air, delivered to the tool 80 through an air hose 124 such as is depicted in FIG. 1 at a pressure and volumetric flow rate capable of rotating the bit 82 at rotational speeds of between zero revolutions per minute and up to 70,000 revolutions per minute during slug retention die modification. Preferably, the air grinder 125 has a rotational speed of at least 55,000 revolutions per minute, and more preferably at least 60,000 revolutions per minute. As a result of the use of the vibration dampening arrangement 168, e.g. elastomeric bumper 170, to provide vibration isolation and dampening between the machining head 28 and carriage 74, using such a high rotational speed groove machining tool 80 that preferably is a high speed pneumatic grinder 125 to machine the grooves 22 not only does so more precisely and uniformly but advantageously also is quieter during slug retention groove machining. Additionally, a high speed pneumatic grinder 125 advantageously runs more true when forming grooves 22.

As a result, use of such an air grinder 125 capable of rotating the groove cutting bit 82 during cutting of grooves 22 at a rotational speed of at least 60,000 revolutions per minute creates more accurate grooves 22 in the sidewall 27 of each die cavity 25 when used with one of the stops **180*a*, 180*b* or 180*c* installed on the machine 20. In addition, the sound and vibration make it easier for a user to hear and feel contact between the rotating bit 82 and the sidewall 27 of the die cavity 25 being slug retention groove modified including hearing and/or feeling the bit 82 as it touches off from the die 24 once the groove 22 is formed. As also shown in FIG. 1, the tool 80, preferably air grinder 125, has a generally cylindrical and elongate housing 118 with the bit 82 extending outwardly from a chuck or collet 120 at one end and a control 122 at its opposite end adjacent an air hose 124 used to regulate the supply of motive power to the tool 80, such as to control the rotational speed of the bit 82 during machining of groove 22. The collet 120 releasably retains the bit 82** in a manner that enables its removal and replacement when needed.

Where the grinder 80 is an air grinder 125, the control 122 can be a generally cylindrical rotary collar carried by the grinder housing 118 that is manually turned in one direction to increase the rotary speed of the rotating bit 82 and manually turned in an opposite direction to reduce the rotary speed of the bit 82, including to stop rotation of the bit 82 when desired. Where the grinder 80 is an air grinder 125, the grinder speed control 122 preferably controls the flow of pressurized or compressed air from the hose 124 into and through a pneumatic motor (not shown) within the housing 118 that rotates the bit 82.

In a preferred embodiment, the slug retention groove machining tool 80 is a pencil grinder or micro-air grinder 125 having an elongate generally cylindrical housing 118, e.g., handle, which has a generally circular cross section or O.D. that is substantially constant along its length enabling the grinder 80 to be clamped in the clamping assembly 110 nearly anywhere along the length of the housing 118. A preferred pencil grinder or micro-air grinder 125 has a generally cylindrical housing 118 between about two inches and about five inches long, enabling the grinder 125 to be clamped substantially anywhere along the length of its housing 118 providing at least two inches and no more than five inches of vertical position or height adjustment of the bit 82 relative to the die cavity 25 generally in the direction of the vertical or second axis 79 prior to performing any further or finer position or height adjustment along the same axis 79 using the vertical slide 104 and/or any of the stops 180*a*, 180*c* or 180*c*. This enables the end or tip of the bit 82 that comes into contact with the sidewall 27 during machining of groove 22 therein to be pre-positioned relative to the cavity 25 of the die 24 using the clamping assembly 110 before more finely positioning the end or tip of the bit 82 relative to the cavity 25 of the die 24 using the horizontal and/or vertical slides 46 and 104. This enables, for example, macro-positioning of the bit 82 generally in the vertical direction relative to the die 24 before performing finer adjustment (a) in the vertical direction (i.e., generally along axis 79) using the vertical slide 104 in combination with whichever stop 180*a*, 180*b* or 180*c* is mounted to the machine 20 and/or (b) in the horizontal direction (i.e., generally along axis 45) using the horizontal slide 46. As shown in FIG. 2, when the machine 20 is mounted on a generally horizontal outer surface 34 of a stamping die 24, the first axis 45 is a generally horizontal axis and the second axis 79 is a generally vertical axis.

In a preferred embodiment, the slug retention groove machining insert 82 is a generally cylindrical grinding bit capable of forming, e.g., grinding or cutting, a recess, preferably an elongate groove, in part of a die cavity-defining sidewall 27 of the die 24. The insert 82 preferably is an elongate generally cylindrical grinding bit, which can be a burr-type die grinding bit, such as a carbide burr pointed-cone die-grinding bit, a carbide burr pointed tree-shaped die-grinding bit, a carbide burr nose tree-shaped die-grinding bit, a carbide burr cylinder die-grinding bit, a carbide burr ball-shaped bit, or another suitable burr-type grinding bit. Of course, other types of bits and cutting inserts can be used, including an insert having a grinding wheel tip or the like.

Where the die 24 is modified to form a slug retention groove 22 using the machine 20, such a groove 22 is elongate but relatively shallow having a length extending from at or adjacent the outer surface of the die cavity 25 to below the depth that the punch of the stamping press used with the die 24 reaches during stamping of a blank or slug during stamping press operation using the die 24. The groove 22 that is machined can be straight or helical depending on the contour or configuration of the cavity 25. Such a groove 22 can be machined in accordance with that disclosed in U.S. Pat. No. 4,543,865, the entirety of which is expressly incorporated herein by reference. Such a groove 22 formed by the slug retention groove forming bit 82 using groove machining tool 80 of machine 20 can be machined to conform to the specifications and characteristics disclosed in U.S. Pat. No. 4,543,865, but which preferably is substantially straight instead of being helical or spiral.

In use and operation, groove machining tool 80 of machine 20 is positioned on a surface, such as the outer or top surface of a die, e.g., die 24, where it is readied for use in modifying a cavity 25 of the die 24 to improve slug retention by machining a groove 22 in part of the die 24 in or along a sidewall 27 defining the die cavity 25. In a preferred method of use, the machine 20 is initially roughly pre-positioned and then more finely adjusted in order to machine part of a cavity sidewall 27 in a manner that forms such a slug retention groove 22 therein that prevents slugs from being pulled out of the slug retention groove modified cavity 25 during stamping press operation.

By being small enough to be used within a stamping press 26, the machine 20 advantageously saves time as it allows one or more die cavities 25 formed in the die 24 to be modified using the machine 20 to subsequently provide slug retention when the press 26 is returned to operation. This advantageously enables the die 24 to be modified to provide slug retention to one or more of its die cavities 25 without having to pull the die 24 out of the press 26 and taking it to the tool room. This not only saves time and returns the press 26 back to operation faster, it also advantageously enables the machine 20 to be used nearly anywhere, on a die in a stamping press, in the tool room on a die being serviced, on a new die before being installed in a stamping press, on takeover dies, as well as on dies that would ordinarily never run without pulling slugs.

In preparation for use, the machine 20 is placed on or in the die 24 with its base 30 resting on the outer surface of the die 24. The base 30 is manually positioned so it is generally perpendicular to an upper edge of a cavity sidewall 27 of the die 24 that defines the die cavity 25 being modified to provide slug retention. The machine 20 is manually positioned so that its machining bit 82 is located adjacent an upper edge of the die cavity sidewall 27 of the die 24 so that the bit 82 will travel alongside part of the surface of the cavity sidewall 27 so that it brushes or touches the sidewall 27 when the tip or end of the bit 82 is lowered into the die cavity 25. Once this pre-positioning step has been done, magnetic mount 36 is activated to magnetically mount the machine base 30 securely in place on the die 24 so it will not move relative to the die 24 during machining of the die 24 to modify the die 24 to provide slug retention.

Where a stop 180*a*, 180*b* or 180*c* is used, the selected stop 180*a*, 180*b* or 180*c* can be installed prior to, during or after the machine 20 is mounted by its base 30 to the die 24. As previously indicated, selection of which one of the plurality of above-described stops 180*a*, 180*b* or 180*c* can be and typically is dependent on operator preference, which could be influenced by at least one of the aforementioned stop selection factors (a)-(h) disclosed above.

In preparation for slug retention groove machining use, the machine base 30 is anchored to the die 24, such as in the manner disclosed above, thereby substantially immovably fixing or grounding the base 30 to the die 24 after generally horizontally macro-positioning the machine 20 relative to the sidewall 27 of the die cavity 25 to at least roughly horizontally locate the head 28 and tool 80 relative to an upper or outer edge of the sidewall 27 so that the bit 82 is located generally above and adjacent the upper or outer edge of the sidewall 27. Once roughly located, base 30 is anchored to the die 24 and the horizontal drive 49 is manipulated by the user to cause the horizontal slide arrangement 46 to horizontally displace the head 28, tool 80 and bit 82 relative to the upper or outer edge of the sidewall 27 so that the machining bit 82 is more precisely located, e.g., micro-positioned, generally above and adjacent thereto. To do so, the horizontal slide drive 49 is manipulated by the user to more precisely horizontally position the bit 82 so that the bit 82 preferably will come into contact with the sidewall 27 when vertically displaced downwardly toward and into the cavity 25 during machining of the groove 22.

Also in preparation for slug retention groove machining use, the tool 80 can be and preferably is positioned or repositioned in the tool holder 105 to vertically macro-position the bit 82 vertically relative to the outer or upper edge of the die cavity sidewall 27 to position the insert 82 at a height above the outer surface 34 of die 24 so that the bit 82 is close to but spaced above the surface 34. To more finely vertically micro-position the bit 82 to set the height of the bit 82 relative to the opening of the die cavity 25 at a desired pre-slug retention groove machining setup position or height relative to the outer or upper edge of the sidewall 27, the selected stop 180*a*, 180*b* or 180*c* is position-adjustably mounted to the machine 20 in the manner disclosed above that enables the stop 180*a*, 180*b* or 180*c* to be moved vertically toward or away from the opening of the cavity 25 in order to set the bit 82 at a desired pre-slug retention groove machining setup position or height.

In a preferred desired pre-slug retention groove machining setup method, the position-adjustably mounted stop 180*a*, 180*b* or 180*c* is slidably vertically moved relative to a ground of the machine 20, preferably relative to swivel plate 90, to locate the upper travel or return position of the head 28, tool 80 and bit 82 in relation to the outer surface 34 and outer or top edge of the sidewall 27 of the die cavity 25 that is to be slug retention groove modified based on the preference of the user. After the bit 82 has been set at a desired pre-slug retention groove machining setup position or height where the bit 82 completely exits the outer surface 34 and outer or top edge of the sidewall 27 of the cavity 25, the stop 180*a*, 180*b*, or 180*c* is position-fixed, e.g. grounded, by stop mounting fasteners 192 and 194 being tightened to substantially immovably fix the position of the stop 180*a*, 180*b*, or 180*c* so the stop 180*a*, 180*b*, or 180*c* does not move during slug retention groove machining.

Once the desired pre-slug retention groove machining setup position or height of the slug retention groove machining bit 82, tool 80 and head 28 has been set relative to surface 34 and top or outer edge of the sidewall 27 defining the die cavity 25 in which a groove 22 is to be machined, the machining head return biasing element 160, preferably spring 161, urges the movable slide block 106*b* and head 28 upwardly in a direction away from the cavity 25 until the vibration dampening arrangement 168, e.g., bumper 170, and machining head travel limiting stop arm 171 and the movable slide block 106*b* come to rest in an uppermost return travel position, e.g., pre-slug retention groove machining setup position. Where stop 180*b* or 180*c* is used, biasing element 160, preferably spring 161, urges the movable slide block 106*b* and head 28 upwardly in a direction away from the die cavity 25 until the damper arrangement 168 and travel limiting stop arm 171 abuts against upper abutment arm 224 or 245 retaining the bit 82 in a preset uppermost return travel position that corresponds to the desired pre-slug retention groove machining setup position and height readying the machine 20 to machine groove 22.

After that, the tool 80 can be powered to cause the slug retention groove forming insert 82 to rotate. Where the tool 80 is an air grinder 125, the grinder 125 is powered by supplying it with compressed air and by turning the air grinder control 122 to an operating position where compressed air causes the insert 82, in this case a grinding bit 82, to rotate.

With continued reference to FIG. 1 once again, user preferably urges the head 28 downwardly displacing the rotating bit 82, from the pre-slug retention groove machining starting or setup position or height, downwardly toward the die cavity opening 25 and into contact with the cavity sidewall 27. The head 28 preferably is urged downwardly until the stop arm 171 abuts against the lower abutment arm 226 of stop 180*a*, 180*b* or 180*c* with the vibration absorbing soft stop provided by the portion of the vibration dampening arrangement 168, e.g. bumper 170, disposed between stop arm 171 and lower abutment arm 226 providing vibration isolation and absorption helping to more precisely and more uniformly machine groove 22 in sidewall 27.

The machining head 28 may be moved up and down by grasping and manually moving the head 28 if desired and as needed to complete machining of groove 22. Where the stop 180*c* that is installed is the adjustable stop 180*c*, the adjuster 240 can be manually operated as a machining head displacement drive 264 by rotating thumbscrew 248 in one direction, e.g. clockwise, to move the bit 82 downwardly during machining of groove 22, and by rotating thumbscrew 248 in an opposite direction, e.g. counter clockwise, to cause the biasing element 160, e.g. spring 161, to urge the head 28 upwardly away from the die cavity 25 thereby returning the bit 82 to the pre-slug retention groove machining setup position and height. During thumbscrew rotation in either direction, vibration isolation and vibration dampening is maintained by the dampening arrangement 168, e.g. bumper 170, substantially continuously maintaining contact with the selectively retractable or extensible upper abutment arm 245 of the stop end 242 formed by the free end of the stem 254 of the thumbscrew 248 helping to produce a more consistent and uniform groove 22 when finished.

If desired or where needed, this process can be repeated one or more times until a slug retention groove 22 of desired depth, width, length or having other desirable characteristics or qualities is produced. The horizontal slide position adjustment knob 72 of the horizontal slide drive 49 can be manually rotated in one direction or another as needed to cause the horizontal slide arrangement 46 to move the head 28, tool 80 and rotating bit 82 generally horizontally closer to the die cavity sidewall 27 where greater groove depth is required and/or move the head 28, tool 80 and rotating bit 82 generally horizontally farther away from the sidewall 27 where needed or desired.

During operation, machining head 28 may be moved up and down by grasping and manually moving the head 28 one or more times to alternately (a) lower the rotating bit 82 into the die cavity 25 causing the bit 82 to at least begin machining the groove 22 in an outer corner or edge of the cavity sidewall 27 at the point where the micrometer 68 is set to zero, and (b) raise the rotating bit 82 out of the cavity 25 such as when machining of the groove 22 is finished or another slug retention groove machining pass by the rotating bit 82 is needed. After the rotating bit 82 has been raised out of the cavity 25 after making at least one slug retention groove machining pass, the horizontal slide position adjustment knob 72 can be turned very slightly to cause the horizontal slide drive 49 to generally horizontally reposition the bit 82 closer to the sidewall 27 before manually downwardly urging the head 28 using the vertical slide arrangement 104 to displace the rotating bit 82 toward the cavity 25 and once again into slug retention groove machining contact with sidewall 27 to increase the depth of the groove 22 being machined therein. This method of making a downward slug retention groove machining pass followed by horizontal machining insert position adjustment to increase the depth of the groove 22 being machined during each subsequent groove machining pass is repeated while monitoring the micrometer 68 in operable cooperation with the horizontal slide drive 49 until its display shows that a desired slug retention groove depth has been achieved with the groove 22 being machined.

Finally, a slug retention groove forming machine 20 constructed in accordance with the invention can also be used to machine an elongate groove in a stripper opening of a die that provides a vent groove shaped the same as the grooves 22 shown in the drawings discussed above that helps reduce suction when the punch is retracting from the die opening or die cavity during stamping press operation. Where the machine 20 is used to machine one or more such vent grooves similar in length and depth as the grooves 22 shown in the drawing figures and discussed above, each vent groove preferably is substantially straight and substantially parallel or coincident with the vertical axis 79 such that it is parallel to the axis along with the punch reciprocates during stamping press operation.

A slug retention groove forming machine 20 or "slug keeper" machine constructed in accordance with the present invention is advantageously versatile in that it is relatively small enabling it to be used to machine slug retention grooves 22 in die cavities or die openings of all shapes, sizes and lengths that can have irregularly shaped opening or cavity shapes or mouths (such as the irregularly shaped cavity or opening 25 of the die 24 shown in FIG. 1) as well as oblong, square, rectangular, circular, and cylindrical die cavity or die openings of varying lengths, widths and depths. A slug retention groove forming machine 20 constructed in accordance with the present invention is advantageously lightweight and compact having a weight less than ten pounds (about eight pounds) enabling a single person to move, setup and use virtually anywhere including on a die in a stamping press without having to first remove the die. Such a machine 20 is also advantageously versatile in that it can be used to machine vent grooves in a stripper opening of a die in a stamping press without having to first remove the die from the stamping press.

With reference to FIGS. 13 and 14, a slug retention groove forming machine 20 constructed in accordance with the invention can be equipped with a slug retention groove and machining imaging and inspection system 130 in accordance with another aspect of the present invention that is used to image and monitor formation of a slug retention groove 22 preferably in real time during actual machining of the groove 22. The inspection system 130 is removably mounted to the machine 20 to provide an enhanced, preferably enlarged or magnified, view of a portion of the sidewall 27 of a die cavity 25 prior to, during, and after machining groove 22 in the sidewall 27. Inspection system 130 includes an optical imaging device 132 that preferably is equipped with an image-magnifying camera 134, although it is understood that in another embodiment, the imaging device 132 may be another type of imaging or optical device. One preferred imaging device 132 well suited for use in providing a user of the machine 20 with an enhanced and/or enlarged image of the portion of the sidewall 27 in which groove 22 is going to be machined (as well as during machining of the groove 22) is a digital microscope 136 that can be a commercially available digital microscope, such as a USB microscope, or another type of microscope capable of producing digital or digitized magnified images and/or video formed of such magnified images.

The imaging device 132, preferably microscope 136, can and preferably does include a camera 134 equipped with a lens 138 that may be an image magnifying lens that is arranged to face generally toward the machine base 30 but aimed generally downwardly into the cavity 25 toward the sidewall 27 that user intends to machine a groove 22 enabling camera 134 to image the sidewall 27, groove 22, including imaging the groove 22 as it is being formed by rotating bit 82, and including imaging the rotating bit 82 while forming groove 22. The machining inspection system 130 can and preferably does further include a camera support 140 formed of a generally rectangular, e.g., square, or cubic, e.g., block-shaped, camera mounting base 142 with a recessed camera seating cradle 144 in which a generally cylindrical housing 148 of the camera 134 is slidably telescopically received releasably holding the camera 134 orienting the focal plane and/or image plane of the lens 138 or camera 134 downwardly into cavity 25 and toward sidewall 27. Cradle 144 can be downwardly angled or inclined and generally U-shaped, e.g., a downwardly inclined U-shaped channel, such as depicted in FIG. 1, but preferably is in the form of a generally downwardly angled or inclined tubular camera seating bore 146, such as depicted in FIG. 14.

The camera support 140 preferably also defines or functions as a vibration isolator, which helps to prevent and/or minimize the camera 134 and video or images captured thereby from shaking or blurring when the rotating bit 82 is in contact with cavity sidewall 27 during machining of groove 22 therein. The base 142 of the support 140 provides vibration dampening or vibration isolation preferably thereby also serving as a camera vibration isolator that isolates the camera 134 from vibration of the die 24 produced when rotating bit 82 contacts sidewall 27 during machining of groove 22 by dampening such vibration, including by reducing the magnitude or amplitude of any such vibrations reaching camera 134 seated in cradle 144 in base 142 during groove machining.

The camera mounting base 142 preferably also is of magnetic construction defining or providing a mounting base 142 that releasably, yet securely, e.g., generally immovably, adheres the camera support 140 to the outer surface 34 of die 24 adjacent the cavity 25 on a side of the cavity 25 opposite the sidewall 27 in which groove 22 is machined or is going to be machined. The mounting base 142 is equipped with at least one permanent magnet (not shown), such as a rare earth magnet, e.g., Alnico magnet, neodymium magnet, or another type of rare earth magnet, which enables the support 140 to be releasably yet securely mounted on the outer surface 34 of a die 24 made of a magnetically attractive metal or metallic material, e.g., iron, steel, and/or stainless steel, and retained thereon in a desired angular orientation that orients a camera 134 seated in cradle 144 so the focal plane and/or image plane of the lens 138 and/or camera 134 is oriented or pointed toward sidewall 27 to image the sidewall 27 prior to, during and/or after machining groove 22 in the sidewall 27. Where the base 142 is equipped with a magnet (not shown), the magnet preferably is disposed inside or in an underside of the base 142, such as by the magnet being received in a pocket formed inside or in the underside of the base 142, locating the magnet close enough to or even in direct contact with the magnetically attractive metallic surface 34 of the die 24 to permit the base 142 and camera 134 to be manually slidably position and/or repositioned generally transversely, e.g., generally horizontally, relative to the die cavity 25 and sidewall 27 closer to or farther away the cavity 25 and/or sidewall 27 to provide clearer, larger and/or better quality video and/or images during imaging system use and operation.

Such a magnetic camera mounting base 142 securely and stably adheres the camera support 140 to the metal die surface 34 in a manner that prevents the support 140 from moving, slipping or sliding around during camera imaging use and operation during groove machining, while also allowing a user to quickly and easily slidably reposition the support 140 on the die 24 by sliding the base 142 along the surface 34 of the die 24 relative to die cavity 25 and/or sidewall 27 so that the lens 138 is pointed towards the location where the groove 22 is being formed. Positioning of the lens 138 of the camera 134 is especially important where the cross-section thickness of the die 24 and/or sidewall 27 is relatively thin and thus making it more difficult to image while operating the machine 20. Such a camera support 140 with a magnetically attractive mounting base 142, in which camera 134 is releasably seated in cradle 144 formed in the base 142, advantageously enables such positioning and repositioning even where used with dies 24 and/or die cavity sidewalls 27 having a cross-sectional thickness less than 5 millimeters, preferably less than about 4 millimeters, and more preferably less than about 3 millimeters, which are more subject to vibration, while also advantageously providing vibration isolation and vibration dampening to seated camera 134.

The camera 134 preferably has an elongate, flexible and bendable gooseneck cable 135 extending rearwardly from the housing 148 of the camera 134 used to electronically connect the camera 134 to a user viewable display 150 of a processor-equipped device 152 that displays images of the die cavity 25, die cavity sidewall 27 and slug retention groove 22 captured by the camera 134 to the user of machine 20, including in streaming video in real time during machining of groove 22 during machine operation. Use of such a gooseneck cable 135 allows positioning and angling of the camera 134 by flexing and bending the cable 135, which substantially retains its shape memory when and after being flexed and/or bent by user, to orient the direction of the camera 134, lens 138, and focal plane and/or image plane thereof, including to facilitate seating in cradle 144 formed in base 142 of camera support 140.

Processor-equipped device 152 preferably is a tablet 154 held by a stand 156 that extends upwardly from a display mount 157 secured to the machine 20, preferably releasably grounded to the machine 20, such as by being removably attached to the carriage mount 76 of the machining head carriage 74. Where the display is a processor-equipped device, processor-equipped device can be a display-equipped or display connected computer, e.g., notebook, laptop, personal computer, desktop computer and/or smartphone, and that includes a display 150, e.g., a display screen, LCD, LED, OLED or the like, which displays the images and/or video outputted by camera 134.

The imaging and inspection system 130 preferably also includes an imaging system controller 133 carried by the display mount 157 that is used to control and/or adjust operation of the camera 134 during imaging system operation. The controller 133 is connected to one end of camera cable 135 and is connected at an opposite end by a cabling arrangement 137 to the display 150, e.g., tablet 154. The controller 133 preferably is equipped with a plurality of camera and/or imaging controls 147 and 149, e.g., a zoom control 147 and/or a brightness or contrast control 149, such as is shown in FIG. 13, which are independently manipulable by the user during transfer and display of video and/or images from camera 134 to the display 150, including in real time during machining of groove 22.

To help produce sharp clear images, including during machining of groove 22, the imaging and inspection system 130 preferably is equipped with at least one spotlight 139 connected by an elongate, flexible and bendable shape-memory position-fixable gooseneck cable 141 to an electrical power source 143 which is releasably attached to the carriage mount 76 of the machining head carriage 74 by an adjustable and/or removable imaging system mounting strap 145. The electrical power source 143 preferably holds one or more rechargeable or disposable batteries, such as alkaline, lithium ion, or nickel cadmium batteries, which supply electricity through cable 141 to spotlight 139 and advantageously enables the imaging system 130 to remain attached by strap 145 to the machine 20 during transport, storage and use of the machine 20. The power source 143 can also be equipped with one or more user operable controls, including an on-off control, e.g., on-off button or switch, and/or a brightness control that controls the number of lumens or brightness of light from spotlight 139 irradiating the area of the cavity 25, sidewall 27, and groove 22 being imaged by camera 134. In a preferred embodiment of the imaging and inspection system 130, the system 130 is equipped with a pair of spotlights 139 each connected by an elongate and flexible shape-memory position-fixable cable 141 each respectively connected to a corresponding power source 143 mounted to opposites sides of the carriage mount 76. In use and operation, the cable 141 of each spotlight 139 is bendable by user as needed or desired into a desired position where it remains substantially fixed in the desired position to orient and/or angle the spotlight 139 generally above and downwardly toward the die cavity 25 and cavity sidewall 27 being machined by bit 82 to form groove 22 therein to illuminate cavity 25 and sidewall 27 being imaged by camera 134 during machining of groove 22 by bit 82.

Understandably, the present invention has been described above in terms of one or more preferred embodiments and methods. It is recognized that various alternatives and modifications may be made to these embodiments and methods, which may include alternative combinations of two or more of the individual features mentioned from the same or different drawings or as otherwise evident from the text and/or drawings, and which are within the scope of the present invention.

What is claimed is:

1. A machine for modifying a sidewall defining a die cavity formed in a die with a slug retention groove comprising:

a base grounding the machine to the die adjacent the die cavity;

a slide arrangement carried by the base, the slide arrangement comprised of a movable slide block that is movable relative to the die cavity in a direction toward or away from the cavity-defining sidewall;

a machining head carried by the movable slide block, the machining head comprised of a slug retention groove forming tool used to form a slug retention groove in the cavity-defining sidewall; and a stop that operatively cooperates with one of the slide arrangement and machining head to limit movement of at least one of the machining head and tool relative to the cavity-defining sidewall;

wherein the stop comprises a travel range limiting stop that limits a range of travel of the machining head and tool relative to the cavity-defining sidewall to a range of travel less than a maximum range of travel.

2. A machine for modifying a sidewall defining a die cavity formed in a die with a slug retention groove comprising:

a base grounding the machine to the die adjacent the die cavity;

a slide arrangement carried by the base, the slide arrangement comprised of a movable slide block that is movable relative to the die cavity in a direction toward or away from the cavity-defining sidewall;

a machining head carried by the movable slide block, the machining head comprised of a slug retention groove forming tool used to form a slug retention groove in the cavity-defining sidewall; and a stop that operatively cooperates with one of the slide arrangement and machining head to limit movement of at least one of the machining head and tool relative to the cavity-defining sidewall;

wherein the stop is configured to provide a predetermined pre-slug retention groove machining head start position relative to the cavity-defining sidewall before the machining head and tool is displaced downwardly and into the die cavity to machine the slug retention groove therein; and wherein the stop is configured to enable adjustment of the predetermined pre-slug retention groove machining head start position.

3. The machine of claim 1, wherein the stop comprises a downward travel motion limiting stop that limits travel of the machining head and tool toward the cavity-defining sidewall.

4. The machine of claim 2, wherein the stop comprises a travel range limiting stop that limits a range of travel of the machining head and tool relative to the cavity-defining sidewall to a range of travel less than a maximum range of travel.

5. The machine of claim 4, wherein the stop comprises an adjustable travel range limiting stop that adjustably limits a range of travel of the machining head and tool relative to the cavity-defining sidewall to a range of travel less than a maximum range of travel.

6. A machine for modifying a sidewall defining a die cavity formed in a die with a slug retention groove comprising:

a base grounding the machine to the die adjacent the die cavity;

a slide arrangement carried by the base, the slide arrangement comprised of a movable slide block that is movable relative to the die cavity in a direction toward or away from the cavity-defining sidewall;

a machining head carried by the movable slide block, the machining head comprised of a slug retention groove forming tool used to form a slug retention groove in the cavity-defining sidewall; and a machining head motion limiter that limits a distance of travel of the machining head in a direction toward the cavity-defining sidewall;

wherein the motion limiter is comprised of one part of the movable slide block that abuts against another part of the slide arrangement that is fixed or grounded when the machining head reaches a position of bottom-most distance of travel relative to the die cavity and cavity-defining sidewall.

7. The machine of claim 6, further comprising a vibration dampening arrangement that isolates the machining head from vibration during formation of the slug retention groove in the cavity-defining sidewall.

8. The machine of claim 7, wherein the vibration dampening arrangement is carried by the one part of the movable slide block that abuts against the another part of the slide arrangement that is fixed or grounded.

9. The machine of claim 6, wherein the motion limiter is comprised of a stop arm of the movable slide block that abuts against an abutment landing of the another part of the slide arrangement that is fixed or grounded stopping any farther movement of the machining head when the machining head reaches a maximum bottom-most travel position relative to the die cavity and cavity-defining sidewall.

10. The machine of claim 9, wherein the motion limiter is a stop that operatively cooperates with the stop arm to limit movement of the machining head and tool relative to the cavity-defining sidewall.

11. The machine of claim 10, wherein the stop comprises a downward travel motion limiting stop spaced from the abutment landing that limits travel of the machining head and tool toward the cavity-defining sidewall to a bottom-most position of travel less than the maximum bottom-most travel position.

12. The machine of claim 10, wherein the stop comprises a travel range limiting stop that operably cooperates with a stop arm of the movable slide block to limit a range of travel of the machining head and tool relative to the cavity-defining sidewall to a range of travel less than a maximum range of travel.

13. The machine of claim 12, wherein the travel range limiting stop has a pair of spaced apart abutment arms defining a stop arm travel recess in which the stop arm of the movable slide block is constrained to travel in the limited machining head and tool range of travel.

14. The machine of claim 12, wherein the stop comprises an adjustable travel range limiting stop that adjustably limits a range of travel of the machining head and tool relative to the cavity-defining sidewall to a range of travel less than a maximum range of travel.

15. The machine of claim 14, wherein the adjustable travel range limiting stop has an adjustable abutment arm defining an adjustable pre-slug retention groove machining start position of the machining head and tool relative to the cavity-defining sidewall.

16. The machine of claim 10, wherein the stop is configured to provide a predetermined pre-slug retention groove machining head start position relative to the cavity-defining sidewall before the machining head and tool is displaced downwardly and into the die cavity to machine the slug retention groove therein.

17. The machine of claim 16, wherein the stop is configured to enable adjustment of the predetermined pre-slug retention groove machining head start position.

18. A machine for modifying a sidewall defining a die cavity formed in a die with a slug retention groove comprising:

a base grounding the machine to the die adjacent the die cavity;

a slide arrangement carried by the base, the slide arrangement comprised of a movable slide block that is movable relative to the die cavity in a direction toward or away from the cavity-defining sidewall; and a machining head carried by the movable slide block, the machining head comprised of a slug retention groove forming tool used to form a slug retention groove in the cavity-defining sidewall;

wherein the slide arrangement further comprises a machining head return position biasing element that urges the movable slide block away from the die cavity returning the slug retention forming tool and machining head to an initial or setup position.

19. The machine of claim 18 wherein the machining head return position biasing element comprises a return spring disposed between the movable slide block and a base of the slide arrangement that is fixed to ground.

20. The machine of claim 19 wherein the return spring is captured in compression between the base and movable slide block of the slide arrangement.

21. The machine of claim 20 wherein the return spring comprises a fluid-powered spring.

22. The machine of claim 21 wherein the return spring comprises a damped spring.

23. The machine of claim 22 wherein the return spring comprises a gas spring.

24. A machine for modifying a sidewall defining a die cavity formed in a die with a slug retention groove comprising:

a base grounding the machine to the die adjacent the die cavity;

a slide arrangement carried by the base, the slide arrangement comprised of a movable slide block that is movable relative to the die cavity in a direction toward or away from the cavity-defining sidewall;

a machining head carried by the movable slide block, the machining head comprised of a slug retention groove forming tool used to form a slug retention groove in the cavity-defining sidewall; and an imaging system comprised of (a) a camera received in a camera support that is releasably and movably mounted on the die adjacent the cavity-defining sidewall to image a slug retention groove being formed therein, and (b) a display mounted to the machine for transport therewith, the display connected to the camera for displaying images therefrom;

wherein the camera Support is comprised of a magnetic base that releasably and movably attaches the camera support to the die.

25. The machine of claim 24, wherein the camera support further comprises a camera-orienting cradle formed therein that orients the camera into the die cavity and toward the cavity-defining sidewall.

26. The machine of claim 25, wherein the imaging system further comprises a light connected to the machine, the light positionable relative to the cavity-defining sidewall by a bendable electrical power cable anchored to the machine.

27. The machine of claim 1, wherein the slide arrangement further comprises a machining head return position biasing element that urges the movable slide block away from the die cavity.

28. The machine of claim 2, further comprising a return spring disposed between the movable slide block and a base of the slide arrangement that is fixed to ground that urges the movable slide block away from the die cavity.

29. The machine of claim 18 further comprising a stop that operatively cooperates with one of the slide arrangement and machining head to limit movement of at least one of the machining head and tool relative to the cavity-defining sidewall.

30. The machine of claim 24 further comprising:

a stop that operatively cooperates with one of the slide arrangement and machining head to limit movement of at least one of the machining head and tool relative to the cavity-defining sidewall; and wherein the slide arrangement further comprises a machining head return position biasing element that urges the movable slide block away from the die cavity returning the slug retention forming tool and machining head to an initial or setup position.

31. The machine of claim 1 further comprising an imaging system that is releasably and movably mounted on the die adjacent the cavity-defining sidewall to image a slug retention groove being formed therein and a display mounted to the machine for transport therewith.

32. The machine of claim 2 further comprising an imaging system comprised of (a) a camera received in a camera support that is releasably and movably mounted on the die adjacent the cavity-defining sidewall to image a slug retention groove being formed therein, and (b) a display mounted to the machine for transport therewith, the display connected to the camera for displaying images therefrom.

* * * * *